US009771547B2

(12) United States Patent
Hulskotter et al.

(10) Patent No.: US 9,771,547 B2
(45) Date of Patent: Sep. 26, 2017

(54) CLEANING COMPOSITIONS CONTAINING A POLYETHERAMINE

(71) Applicant: The Procter & Gamble Company, Cincinnati, OH (US)

(72) Inventors: Frank Hulskotter, Bad Duerkheim (DE); Brian Joseph Loughnane, Fairfield, OH (US); Stefano Scialla, Rome (IT); Sophia Ebert, Mannheim (DE); Bjoern Ludolph, Ludwigshafen (DE); Christof Wigbers, Mannheim (DE); Steffen Maas, Bubenheim (DE); Dieter Boeckh, Limburgerof (DE); Christian Eidamshaus, Ludwigshafen (DE)

(73) Assignee: The Procter & Gamble Company, Cincinnati, OH (US)

( * ) Notice: Subject to any disclaimer, the term of this patent is extended or adjusted under 35 U.S.C. 154(b) by 171 days.

(21) Appl. No.: 14/670,511

(22) Filed: Mar. 27, 2015

(65) Prior Publication Data

US 2015/0275144 A1 Oct. 1, 2015

Related U.S. Application Data

(60) Provisional application No. 61/971,478, filed on Mar. 27, 2014.

(51) Int. Cl.

| | |
|---|---|
| ***C11D 1/00*** | (2006.01) |
| ***C11D 3/30*** | (2006.01) |
| ***C11D 3/386*** | (2006.01) |
| ***C11D 3/37*** | (2006.01) |
| ***C11D 11/00*** | (2006.01) |
| ***C11D 1/48*** | (2006.01) |
| ***C11D 1/72*** | (2006.01) |
| ***C11D 1/42*** | (2006.01) |

(52) U.S. Cl.

CPC ..... *C11D 3/3723* (2013.01); *C11D 1/00* (2013.01); *C11D 1/42* (2013.01); *C11D 1/48* (2013.01); *C11D 1/721* (2013.01); *C11D 3/30* (2013.01); *C11D 3/386* (2013.01); *C11D 3/38618* (2013.01); *C11D 3/38645* (2013.01); *C11D 11/0017* (2013.01)

(58) Field of Classification Search

CPC ..... C11D 1/00; C11D 1/3723; C11D 3/30; C11D 3/386; C11D 3/38645; C11D 3/38618; C11D 11/0017

USPC ..... 510/421, 422, 426, 427, 499, 505, 506; 8/137

See application file for complete search history.

(56) References Cited

U.S. PATENT DOCUMENTS

| | | | |
|---|---|---|---|
| 3,654,370 | A | 4/1972 | Yeakey et al. |
| 4,450,091 | A | 5/1984 | Schmolka |
| 4,537,705 | A | 8/1985 | Mahoney et al. |
| 4,556,509 | A | 12/1985 | Demangeon et al. |
| 4,609,683 | A | 9/1986 | Grigsby, Jr. et al. |
| 4,764,291 | A | 8/1988 | Steltenkamp et al. |
| 4,820,436 | A | 4/1989 | Andree et al. |
| 5,317,076 | A | 5/1994 | Primeaux, II |
| 5,571,286 | A | 11/1996 | Connell et al. |
| 5,863,886 | A | 1/1999 | Tracy et al. |
| 5,948,744 | A | 9/1999 | Baillely et al. |
| 6,146,427 | A | 11/2000 | Crutcher |
| 6,172,021 | B1 | 1/2001 | Ofosu-Asante et al. |
| 6,172,024 | B1 | 1/2001 | Arvanitidou |
| 6,191,099 | B1 | 2/2001 | Crutcher |
| 6,347,055 | B1 | 2/2002 | Motomura |
| 6,365,561 | B1 | 4/2002 | Vinson et al. |
| 6,369,024 | B1 | 4/2002 | Panandiker et al. |
| 6,437,055 | B1 | 8/2002 | Moriarity et al. |
| 6,506,716 | B1 | 1/2003 | Delplancke et al. |
| 6,589,926 | B1 | 7/2003 | Vinson et al. |
| 6,652,667 | B2 | 11/2003 | Ahmadi et al. |
| 6,710,023 | B1 | 3/2004 | Bodet et al. |
| 6,857,485 | B2 | 2/2005 | Patel et al. |
| 6,951,710 | B2 | 10/2005 | Rieker et al. |
| 7,037,883 | B2 | 5/2006 | Hsu et al. |
| 7,387,992 | B2 | 6/2008 | Hsu et al. |
| 7,816,481 | B2 | 10/2010 | Klein et al. |
| 8,097,577 | B2 | 1/2012 | Danziger et al. |
| 8,193,144 | B2 | 6/2012 | Tanner et al. |
| 8,247,368 | B2 | 8/2012 | Danziger et al. |
| 8,471,065 | B2 | 6/2013 | Burton et al. |
| 8,586,039 | B2 | 11/2013 | Tsuchiya et al. |
| 8,815,007 | B2 | 8/2014 | Tanner et al. |
| 9,193,939 | B2 * | 11/2015 | Hulskotter et al. .. C11D 3/0036 |
| 2002/0147368 | A1 | 10/2002 | Li et al. |
| 2005/0027141 | A1 | 2/2005 | Furushima et al. |

(Continued)

FOREIGN PATENT DOCUMENTS

| | | |
|---|---|---|
| DE | 1643426 A1 | 3/1979 |
| EP | 1664254 B9 | 8/2004 |

(Continued)

OTHER PUBLICATIONS

Jeffamine D-400 Polyetheramine, p. 1-2, 2007.*
Jeffamine D-230 Polyetheramine, p. 1-2, 2007.*
International Search Report for PCT/US2014/031939, dated Jul. 7, 2014, containing 14 pages.
International Search Report for PCT/US2014/031941, dated Jul. 3, 2014, containing 14 pages.

(Continued)

*Primary Examiner* — Gregory R Delcotto
(74) *Attorney, Agent, or Firm* — Gregory S. Darley-Emerson; Leonard W Lewis; Steven W Miller

(57) ABSTRACT

The present invention relates generally to cleaning compositions and, more specifically, to cleaning compositions containing a polyetheramine that is suitable for removal of stains from soiled materials.

13 Claims, No Drawings

(56) References Cited

U.S. PATENT DOCUMENTS

| | | | |
|---|---|---|---|
| 2006/0074004 | A1 | 4/2006 | Johnson et al. |
| 2010/0323943 | A1 | 12/2010 | Evers et al. |
| 2011/0009670 | A1 | 1/2011 | Renken et al. |
| 2012/0259075 | A1 | 10/2012 | Klein et al. |
| 2012/0309884 | A1 | 12/2012 | Walker et al. |
| 2013/0291315 | A1 | 11/2013 | Bennett et al. |
| 2014/0255330 | A1 | 9/2014 | Cron et al. |
| 2014/0296124 | A1 | 10/2014 | Hulskotter et al. |
| 2014/0296127 | A1 | 10/2014 | Hulskotter et al. |
| 2015/0057212 | A1 | 2/2015 | Hulskotter et al. |
| 2015/0275142 | A1 | 10/2015 | Hulskotter et al. |

FOREIGN PATENT DOCUMENTS

| | | | |
|---|---|---|---|
| EP | 1436374 | B1 | 8/2008 |
| GB | 581 994 | A | 10/1946 |
| JP | 2011/0001504 | | 1/2011 |
| WO | WO 86/07603 | | 12/1986 |
| WO | WO 90/03423 | | 4/1990 |
| WO | WO 97/30103 | | 8/1997 |
| WO | WO 98/28393 | | 7/1998 |
| WO | WO 00/63334 | | 10/2000 |
| WO | WO 01/27232 | A1 | 4/2001 |
| WO | WO 01/76729 | A2 | 10/2001 |
| WO | WO 2009/065738 | A3 | 9/2009 |
| WO | WO 2012/126665 | A1 | 9/2012 |

OTHER PUBLICATIONS

International Search Report for PCT/US2014/051165, dated Dec. 1, 2014, containing 10 pages.

International Search Report for PCT/US2015/021968, dated Jul. 9, 2015, containing 11 pages.

www.huntsman.com/portal/page/.../jeffamine_polyetheramines, downloaded on Jun. 9, 2015 (PDF Attached).

International Search Report for PCT/US2015/021970, dated Jul. 8, 2015, containing 13 pages.

International Search Report for PCT/US2015/022927, dated Sep. 11, 2015, containing 12 pages.

* cited by examiner

CLEANING COMPOSITIONS CONTAINING A POLYETHERAMINE

TECHNICAL FIELD

The present invention relates generally to cleaning compositions and, more specifically, to cleaning compositions containing a polyetheramine that is suitable for removal of stains from soiled materials.

BACKGROUND

Due to the increasing popularity of easy-care fabrics made of synthetic fibers as well as the ever increasing energy costs and growing ecological concerns of detergent users, the once popular warm and hot water washes have now taken a back seat to washing fabrics in cold water (30° C. and below). Many commercially available laundry detergents are even advertised as being suitable for washing fabrics at 15° C. or even 9° C. To achieve satisfactory washing results at such low temperatures, results comparable to those obtained with hot-water washes, the demands on low-temperature detergents are especially high.

It is known to include certain additives in detergent compositions to enhance the detergent power of conventional surfactants, so as to improve the removal of grease stains at temperatures of 30° C. and below. For example, laundry detergents containing an aliphatic amine compound, in addition to at least one synthetic anionic and/or nonionic surfactant, are known. Also, the use of linear, alkyl-modified (secondary) alkoxypropylamines in laundry detergents to improve cleaning at low temperatures is known. These known laundry detergents, however, are unable to achieve satisfactory cleaning at cold temperatures.

Furthermore, the use of linear, primary polyoxyalkyleneamines (e.g., Jeffamine® D-230) to stabilize fragrances in laundry detergents and provide longer lasting scent is also known. Also, the use of high-moleculer-weight (molecular weight of at least about 1000), branched, trifunctional, primary amines (e.g., Jeffamine® T-5000 polyetheramine) to suppress suds in liquid detergents is known. Additionally, an etheramine mixture containing a monoether diamine (e.g., at least 10% by weight of the etheramine mixture), methods for its production, and its use as a curing agent or as a raw material in the synthesis of polymers are known. Finally, the use of compounds derived from the reaction of diamines or polyamines with alkylene oxides and compounds derived from the reaction of amine terminated polyethers with epoxide functional compounds to suppress suds is known.

There is a continuing need for a detergent additive that can improve cleaning performance at low wash temperatures, e.g., at 30° C. or even lower, without interfering with the production and the quality of the laundry detergents in any way. More specifically, there is a need for a detergent additive that can improve cold water grease cleaning, without adversely affecting particulate cleaning. Surprisingly, it has been found that the cleaning compositions of the invention provide increased grease removal (particularly in cold water).

SUMMARY

The present invention attempts to solve one more of the needs by providing a cleaning composition (in liquid, powder, unit dose, pouch, or tablet forms) comprising from about 1% to about 70%, by weight of the composition, of a surfactant and from about 0.1% to about 10% by weight of a polyetheramine of Formula (I):

Formula (I)

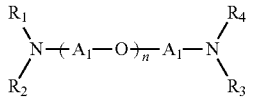

where each $A_1$ group is independently selected from the group consisting of a saturated or unsaturated, straight or branched alkylene radical and a cycloalkylene radical, each of $R_1$-$R_4$ is independently selected from the group consisting of H, a straight or branched alkyl, and a cycloalkyl, n is from about 1 to about 200, and at least one of the $A_1$ groups is selected from:

Formula (II)

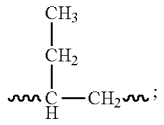

Formula (III)

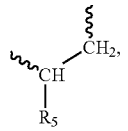

wherein $R_5$ is selected from a linear or branched $C_1$-$C_{12}$ alkyl or a cycloalkyl;

Formula (IV)

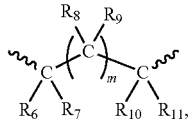

wherein each of $R_6$-$R_{11}$ is independently selected from H, a linear or branched $C_1$-$C_{12}$ alkyl, or a cycloakyl, and m is from about 2 to about 13;

Formula (V)

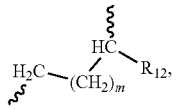

wherein $R_{12}$ is a linear or branched $C_1$-$C_{12}$ alkyl, or a cycloalkyl and m is from about 2 to about 13;

Formula (VI)

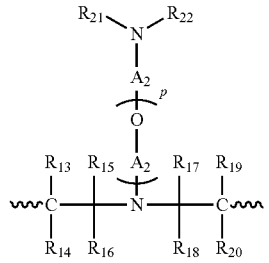

where each $A_2$ group is independently selected from the group consisting of a saturated or unsaturated, straight or branched alkylene radical and a cycloalkylene radical, each of $R_{13}$-$R_{22}$ is independently selected from H, a linear or branched $C_1$-$C_{12}$ alkyl, or a cycloalkyl, and p is from about 0 to about 13.

The invention also relates to a cleaning composition (in liquid, powder, unit dose, pouch, or tablet forms) comprising from about 1% to about 70%, by weight of the composition, of a surfactant and from about 0.1% to about 10% by weight of a polyetheramine of Formula (I):

Formula (I)

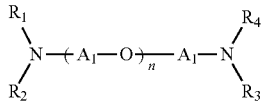

where each $A_1$ group is independently selected from the group consisting of a saturated or unsaturated, straight or branched alkylene radical and a cycloalkylene radical, each of $R_1$-$R_4$ is independently selected from the group consisting of H, a straight or branched alkyl, and a cycloalkyl, n is from about 1 to about 200, at least one of the $A_1$ groups is selected from:

Formula (IX)

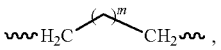

wherein m is from about 2 to about 13;
and at least one of the $A_1$ groups is selected from:

Formula (VIII)

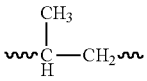

Formula (II)

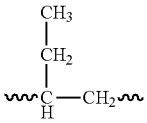

Formula (III)

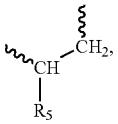

wherein $R_5$ is selected from a linear or branched $C_1$-$C_{12}$ alkyl or a cycloalkyl;

Formula (IV)

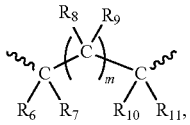

wherein each of $R_6$-$R_{11}$ independently selected from H, a linear or branched $C_1$-$C_{12}$ alkyl, or a cycloalkyl and m is from about 2 to about 13;

Formula (V)

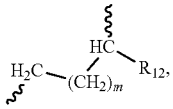

wherein $R_{12}$ is a linear or branched $C_1$-$C_{12}$ alkyl, or a cycloalkyl and m is from about 2 to about 13;

Formula (VI)

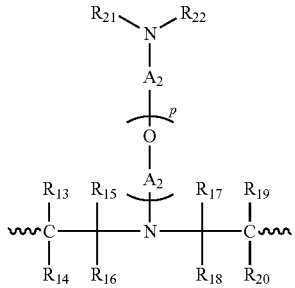

where each $A_2$ group is independently selected from the group consisting of a saturated or unsaturated, straight or branched alkylene radical and a cycloalkylene radical, each of $R_{13}$-$R_{22}$ is independently selected from H, a linear or branched $C_1$-$C_{12}$ alkyl, or a cycloalkyl, and p is from about 0 to about 13.

The invention further relates to a cleaning composition (in liquid, powder, unit dose, pouch, or tablet forms) comprising from about 1% to about 70%, by weight of the composition, of a surfactant and from about 0.1% to about 10% by weight of a polyetheramine selected from one or more of the following:

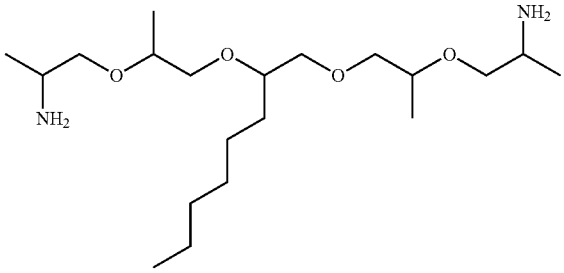

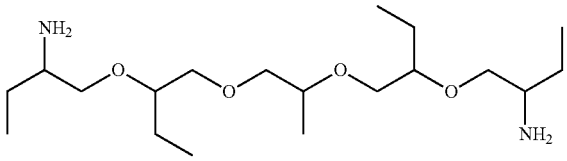

-continued

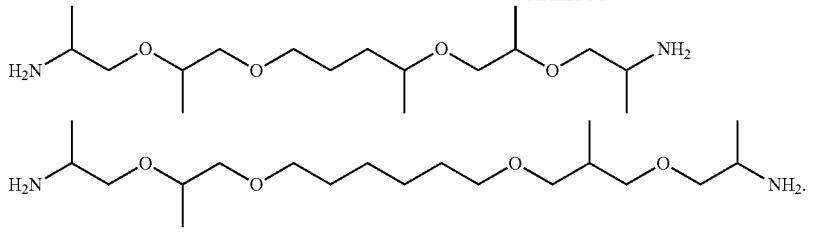

The present invention further relates to methods of cleaning soiled materials. Such methods include pretreatment of soiled material comprising contacting the soiled material with the cleaning compositions of the invention.

The cleaning compositions may further comprise one or more adjunct cleaning additives.

DETAILED DESCRIPTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

The term "substantially free of" or "substantially free from" as used herein refers to either the complete absence of an ingredient or a minimal amount thereof merely as impurity or unintended byproduct of another ingredient. A composition that is "substantially free" of/from a component means that the composition comprises less than about 0.5%, 0.25%, 0.1%, 0.05%, or 0.01%, or even 0%, by weight of the composition, of the component.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the cleaning composition unless otherwise specified.

Cleaning Composition

As used herein the phrase "cleaning composition" or "detergent composition" includes includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The cleaning compositions may have a form selected from liquid, powder, single-phase or multi-phase unit dose, pouch, tablet, gel, paste, bar, or flake.

Polyetheramines

The cleaning compositions described herein may include from about 0.1% to about 10%, or from about 0.2% to about 5%, or from about 0.5% to about 3%, by weight the composition, of a polyetheramine.

The polyetheramine may be represented by the structure of Formula (I):

Formula (I)

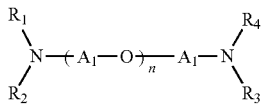

where each $A_1$ group is independently selected from the group consisting of a saturated or unsaturated, straight or branched alkylene radical and a cycloalkylene radical, each of $R_1$-$R_4$ is independently selected from the group consisting of H, a straight or branched alkyl, and a cycloalkyl, n is from about 1 to about 200, and at least one of the $A_1$ groups is selected from:

Formula (II)

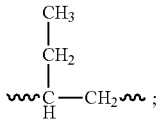

Formula (III)

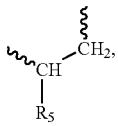

wherein $R_5$ is selected from a linear or branched $C_1$-$C_{12}$ alkyl or a cycloalkyl;

Formula (IV)

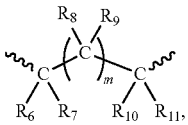

wherein each of $R_6$-$R_{11}$ is independently selected from H, a linear or branched $C_1$-$C_{12}$ alkyl, or a cycloalkyl and m from about 2 to about 13;

Formula (V)

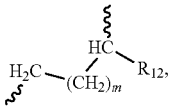

wherein $R_{12}$ is a linear or branched $C_1$-$C_{12}$ alkyl, or a cycloalkyl and m is from about 2 to about 13;

Formula (VI)

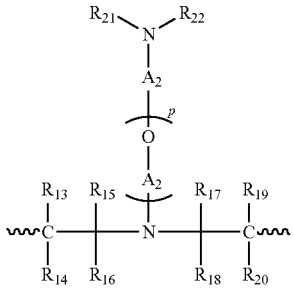

where each $A_2$ group is independently selected from the group consisting of a saturated or unsaturated, straight or branched alkylene radical and a cycloalkylene radical, or each $A_2$ group is independently selected from linear or branched alkylene groups having from about 2 to about 10 carbon atoms or from about 2 to about 4 carbon atoms, or each $A_2$ group is independently selected from linear or branched butylene, linear or branched propylene, or linear or branched ethylene, $R_{13}$-$R_{22}$ is independently selected from H, a linear or branched $C_1$-$C_{12}$ alkyl, or a cycloalkyl, and p is from about 0 to about 13. The $A_1$ groups in Formula (I) may be identical. Optionally, Formula (I) may further comprise at least one $A_1$ group selected from:

Formula (VII)

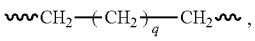

wherein q is 0 or 1; or

Formula (VIII)

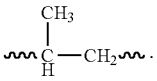

Optionally, in Formula (I), where at least one of the $A_1$ groups is selected from Formulas II-VI, the remaining $A_1$ group(s) is selected from:

Formula (II)

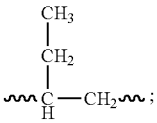

Formula (III)

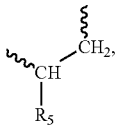

wherein $R_5$ is selected from a linear or branched $C_1$-$C_{12}$ alkyl or a cycloalkyl;

Formula (IV)

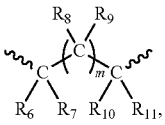

wherein each of $R_6$-$R_{11}$ is independently selected from H, a linear or branched $C_1$-$C_{12}$ alkyl, or a cycloalkyl and m is from about 2 to about 13;

Formula (V)

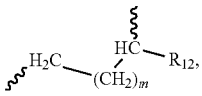

wherein $R_{12}$ is a linear or branched $C_1$-$C_{12}$ alkyl, or a cycloalkyl and m is from about 2 to about 13;

Formula (VI)

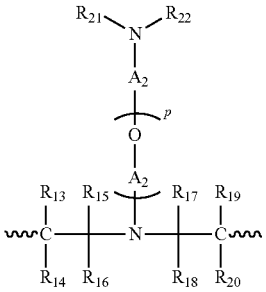

where each $A_2$ group is independently selected from the group consisting of a saturated or unsaturated, straight or branched alkylene radical and a cycloalkylene radical, or each $A_2$ group is independently selected from linear or branched alkylene groups having from about 2 to about 10 carbon atoms or from about 2 to about 4 carbon atoms, or each $A_2$ group is independently selected from linear or branched butylene, linear or branched propylene, or linear or branched ethylene, each of $R_{13}$-$R_{22}$ is independently selected from H, a linear or branched $C_1$-$C_{12}$ alkyl, or a cycloalkyl, and p is from about 0 to about 13;

Formula (VII)

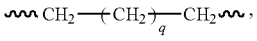

wherein q is 0 or 1; or

Formula (VIII)

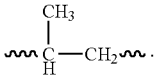

At least one of the $A_1$ groups in Formula (I) may be selected from:

Formula (II)

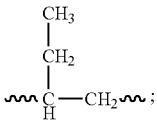

Formula (III)

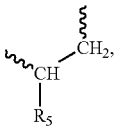

wherein $R_5$ is selected from a linear or brandied $C_1$-$C_{12}$ alkyl or a cycloalkyl;

Formula (IV)

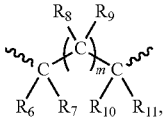

wherein each of $R_6$-$R_{11}$ is independently selected from H, a linear or branched $C_1$-$C_{12}$ alkyl, or a cycloalkyl and m is from about 2 to about 13;

Formula (V)

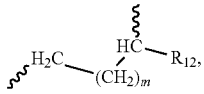

wherein R is selected from H, a linear or branched. $C_1$-$C_{12}$ alkyl, or a cycloalkyl and m is from about 2 to about 13.

At least one of the $A_1$ groups in Formula (I), may be selected from:

Formula (II)

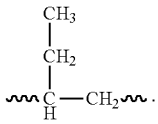

At least one of the $A_1$ groups in Formula (I), may be selected from:

Formula (VI)

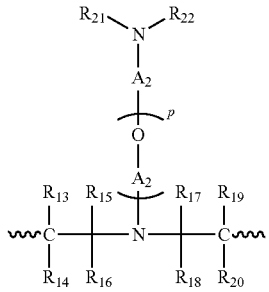

where each $A_2$ group is independently selected from the group consisting of a saturated or unsaturated, straight or branched alkylene radical and a cycloalkylene radical, or each $A_2$ group is independently selected from linear or branched alkylene groups having from about 2 to about 10 carbon atoms or from about 2 to about 4 carbon atoms, or each $A_2$ group is independently selected from linear or branched butylene, linear or branched propylene, or linear or branched ethylene, each of $R_{13}$-$R_{22}$ is independently selected from H, a linear or branched $C_1$-$C_{12}$ alkyl, or a cycloalkyl, and p is from about 0 to about 13; and at least one of the $A_1$ groups in Formula (I) is:

Formula (II)

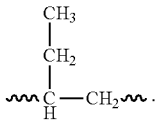

The polyetheramine may be represented by the structure of Formula (I):

Formula (I)

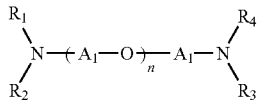

where each $A_1$ group is independently selected from the group consisting of a saturated or unsaturated, straight or branched alkylene radical and a cycloalkylene radical, each of $R_1$-$R_4$ is independently selected from the group consisting of H, a straight or branched alkyl, and a cycloalkyl, n is from about 1 to about 200, at least one of the $A_1$ groups is selected from:

Formula (IX)

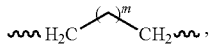

where m is from about 2 to about 13;
and at least one of the $A_1$ groups is selected from:

Formula (VIII)

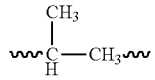

Formula (II)

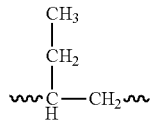

Formula (III)

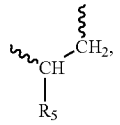

where $R_5$ is selected from a linear or branched $C_1$-$C_{12}$ alkyl or a cycloalkyl;

Formula (IV)

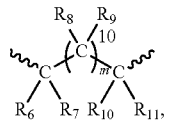

where each of $R_6$-$R_{11}$ is independently selected from H, a linear or branched $C_1$-$C_{12}$ alkyl, or a cycloalkyl and m is from about 2 to about 13;

Formula (V)

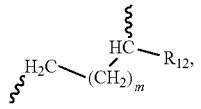

where $R_{12}$ is selected from a linear or branched $C_1$-$C_{12}$ alkyl, or a cycloalkyl and m is from about 2 to about 13; or Formula (VI)

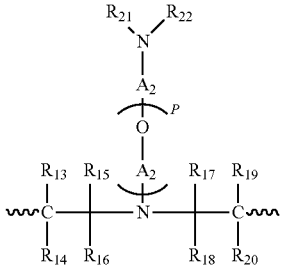

where each $A_2$ group is independently selected from the group consisting of a saturated or unsaturated, straight or branched alkylene radical and a cycloalkylene radical, or each $A_2$ group is independently selected from linear or branched alkylene groups having from about 2 to about 10 carbon atoms or from about 2 to about 4 carbon atoms, or each $A_2$ group is independently selected from linear or branched butylene, linear or branched propylene, or linear or branched ethylene, each of $R_{13}$-$R_{22}$ is independently selected from H, a linear or branched $C_1$-$C_{12}$ alkyl, or a cycloalkyl, and p is from about 0 to about 13.

At least one of the $A_1$ groups in Formula (I) may be selected from:

Formula (IX)

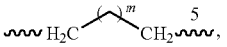

wherein m is from about 2 to about 13;
and at least one of the $A_1$ groups may be selected from:

Formula (VIII)

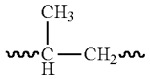

Formula (II)

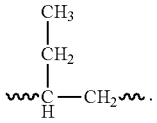

Each of $R_1$-$R_4$ in Formula (I) may be H. Each of $R_1$-$R_4$ may be independently selected from a C1-C16 alkyl or an aryl. Each of $R_1$-$R_4$ may be independently selected from H, butyl, ethyl, methyl, propyl, or phenyl. At least one of $R_1$-$R_4$ may be a methyl group.

n in Formula (I) may be from about 1 to about 20, or about 2 to about 10, or about 2 to about 5, or about 3 to about 5, or about 3, or about 4.

The $A_1$ groups of Formula (I) may be identical or different and the resulting polymer may have a block-wise structure or a random structure. And, as used herein, the squiggly line (∿) indicates where Formulas II-IX connect to Formula (I).

The polyetheramine of the present disclosure may be selected from Formula A, Formula B, Formula C, Formula D, or mixtures thereof:

Formula (A)

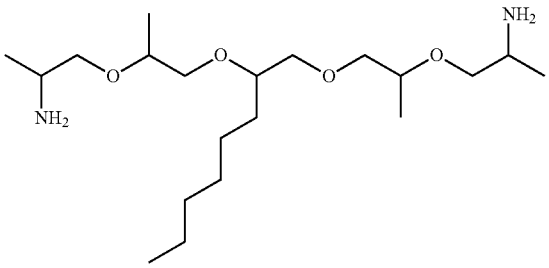

Formula (B)

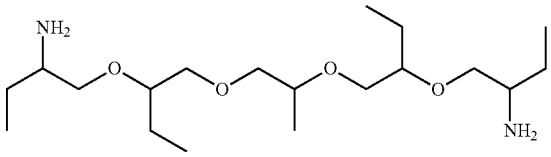

Formula (C)

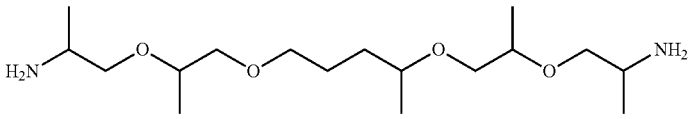

Formula (D)

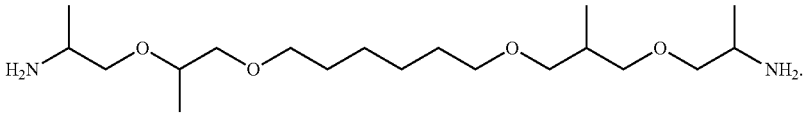

The polyetheramine of Formula (I) may have a weight average molecular weight of about 290 to about 900 grams/mole, or about 300 to about 700 grams/mole, or about 300 to about 450 grams/mole. The molecular mass of a polymer differs from typical molecules in that polymerization reactions produce a distribution of molecular weights, which is summarized by the weight average molecular weight. The polyetheramine polymers of the invention are thus distributed over a range of molecular weights. Differences in the molecular weights are primarily attributable to differences in the number of monomer units that sequence together during synthesis. With regard to the polyetheramine polymers of the invention, the monomer units are represented by Formulas (II)-(IX). The resulting polyetheramine polymers are characterized by the sequence of monomer units. The polyetheramine polymers comprise a distribution of sequences of monomers and, hence, a distribution of molecular weights. Unreacted monomers, such as unreacted alkylene oxide monomer, may also be present in the resulting polyetheramine.

The polyetheramine may comprise a mixture of the various species of Formula (I)-species including various combinations of the monomer units represented by Formulas (II)-(IX).

The polyetheramine may comprise a polyetheramine mixture comprising at least 90%, by weight of the polyetheramine mixture, of the polyetheramine of Formula (I). The polyetheramine may comprise a polyetheramine mixture comprising at least 95%, by weight of the polyetheramine mixture, of the polyetheramine of Formula (I).

SYNTHESIS EXAMPLES

Example 1

1 mol 1,4 butanediol+4 mole propylene oxide, aminated a) 1 Mol 1,4 butanediol+4 mole propylene oxide In a 2 l autoclave 180.4 g 1,4-butanediol, and 1.3 g potassium tert. butoxide were mixed and stirred under vacuum (<10 mbar) at 120° C. for 0.5 h. The autoclave was purged with nitrogen and heated to 140° C. 464.0 g propylene oxide was added in portions within 5 h. To complete the reaction, the mixture was allowed to post-react for additional 8 h at 140° C. The reaction mixture was stripped with nitrogen and volatile compounds were removed in vacuo at 80° C. The catalyst was removed by adding 10.0 g synthetic magnesium silicate (Macrosorb MP5plus, Ineos Silicas Ltd.) stiffing at 100° C. for 2 h and dewatering in vacuo for 2 hours. After filtration 644.0 g of a light yellowish oil was obtained (hydroxy value: 321.3 mgKOH/g).

b) 1 Mol 1,4 butanediol+4 mole propylene oxide, aminated

In a 9 l autoclave 500 mL of the resulting diol mixture from example 1-a, 1200 mL of THF and 1500 g of ammonia were mixed in the presence of 200 mL of a solid catalyst. The catalyst containing oxides of nickel, copper and molybdenum on zirconium dioxide was in the form of 3×3 mm tablets. The autoclave was purged with hydrogen and pressurized to 10 bar before the mixture was heated to 205° C. The pressure was increased to 280 bar and the reaction mixture was stirred for 15 hours at 205° C. and the total pressure was maintained at 280 bar. After 15 hours the autoclave was cooled to ambient temperature, the product was collected, filtered, and stripped on a rotary evaporator to remove light amines and water. A total of 300 grams of a low-color polyetheramine mixture was isolated. The analytical results thereof are shown in Table 1.

TABLE 1

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 344.20 | 346.90 | 2.40 | 2.00 | 4.70 | 98.65 | 99.30 |

Example 2

1 mol 1,6-hexanediol+4 mole propylene oxide, aminated a) 1 mol 1,6-Hexanediol+4 mole propylene oxide In a 21 autoclave 236.4 g 1,6-hexanediol, and 1.4 g potassium tert. butoxide were mixed and the autoclave was purged three times with nitrogen and heated to 140° C. 464.0 g propylene oxide was added in portions within 5 h. To complete the reaction, the mixture was allowed to post-react for additional 8 h at 140° C. The reaction mixture was stripped with nitrogen and volatile compounds were removed in vacuo at 80° C. The catalyst was removed by adding 11.0 g synthetic magnesium silicate (Macrosorb MP5plus, Ineos Silicas Ltd.) stiffing at 100° C. for 2 h and dewatering in vacuo for 2 hours. After filtration 699.0 g of a light yellowish oil was obtained (hydroxy value: 293.0 mgKOH/g).

b) 1 mol 1,6-Hexanediol+4 mole propylene oxide, aminated

In a 9 l autoclave 500 mL of the resulting diol mixture from example 2-a, 1200 mL of THF and 1500 g of ammonia were mixed in the presence of 200 mL of a solid catalyst. The catalyst containing oxides of nickel, copper and molybdenum on zirconium dioxide was in the form of 3×3 mm tablets. The autoclave was purged with hydrogen and pressurized to 10 bar before the mixture was heated to 205° C. The pressure was increased to 280 bar and the reaction mixture was stirred for 15 hours at 205° C. and the total pressure was maintained at 280 bar. After 15 hours the autoclave was cooled to ambient temperature, the product was collected, filtered, and stripped on a rotary evaporator to remove light amines and water. A total of 300 grams of a low-color polyetheramine mixture was isolated. The analytical results thereof are shown in Table 2.

TABLE 2

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 319.00 | 328.40 | 1.61 | 0.45 | 9.85 | 97.00 | 99.50 |

Example 3

1 mol triethanolamine+4 mole butylene oxide, aminated a) 1 mol triethanolamine+4 mole butylene oxide In a 2 l autoclave 208.9 g triethanolamine and 3.25 g potassium hydroxide (50% in water) were mixed at 80° C. and stirred under vacuum (<10 mbar) at 100° C. for 2 h. The autoclave was purged three times with nitrogen and heated to 140° C. 604.8 g butylene oxide was added in portions within 6 h. To complete the reaction, the mixture was allowed to post-react for additional 7 h at 140° C. The reaction mixture was stripped with nitrogen and volatile compounds were removed in vacuo at 80° C. The catalyst was removed by adding 24.6 g synthetic magnesium silicate (Macrosorb MP5plus, Ineos Silicas Ltd.) stirring at 100° C. for 2 h and dewatering in vacuo for 2 hours. After filtration 820.0 g of a light yellowish oil was obtained (amine value: 92.6 mgKOH/g).

b) 1 mol triethanolamine+4 mole butylene oxide, aminated

In a 91 autoclave 700 g of the resulting diol mixture from example 3-a, 500 mL of THF and 1500 g of ammonia were mixed in the presence of 200 mL of a solid catalyst. The catalyst containing oxides of nickel, copper and molybdenum on zirconium dioxide was in the form of 3×3 mm tablets. The autoclave was purged with hydrogen and pressurized to additional 20 bar before the mixture was heated to 205° C. The pressure was increased to 280 bar and the reaction mixture was stirred for 15 hours at 205° C. and the total pressure was maintained at 280 bar. After 15 hours the autoclave was cooled to ambient temperature, the product was collected, filtered, and stripped on a rotary evaporator to remove light amines and water. A total of 550 grams of a low-color polyetheramine mixture was isolated. The analytical results thereof are shown in Table 3.

TABLE 3

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 440.85 | 436.30 | 89.16 | 9.50 | 4.95 | 98.89 | 79.78 |

Example 4

1 mole 1,2-propanediol+4 mole butylene oxide, aminated a) 1 mole 1,2-propandiol+4 mole butylene oxide A 2 L autoclave was charged with 152.2 g 1,2-propanediol and 1.5 g potassium tert.-butylate and heated to 120° C. The autoclave was purged three times with nitrogen and heated to 140° C. 576.0 g butylene oxide was added in portions within 10 h. To complete the reaction, the mixture was stirred and allowed to post-react for additional 8 hours at 140° C. The reaction mixture was stripped with nitrogen and volatile compounds were removed in vacuo at 80° C. The catalyst was removed by adding 23.0 g synthetic magnesium silicate (Macrosorb MP5plus, Ineos Silicas Ltd.), stirring at 100° C. for 2 hours, and filtrating. A light yellowish oil was obtained (730.1 g, hydroxy value: 251.7 mgKOH/g).

b) 1 mole 1,2-propanediol+4 mole butylene oxide, aminated

In a 9 L autoclave 650 g of the resulting liquid diol mixture from example 1-a, 1050 mL THF and 1500 g ammonia were mixed in presence of 200 mL of a solid catalyst as described in EP 0 696 572 B1. The catalyst containing nickel, copper, molybdenum and zirconium was in the form of 3×3 mm tablets. The autoclave was purged with hydrogen, and the reaction was started by heating the autoclave. The reaction mixture was stirred for 15 hours at 205° C., and the total pressure was maintained at 280 bar by purging hydrogen during the entire reductive amination step. After cooling down the autoclave, the final product was collected, filtered, vented of excess ammonia, and stripped on a rotary evaporator to remove light amines and water. A total of 500 grams of a low-color polyetheramine mixture was recovered. The analytical results thereof are shown in Table 4.

TABLE 4

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 294.00 | 301.30 | 0.46 | 0.19 | 7.49 | 97.52 | 99.84 |

Example 5

1 mol 1,2-pentanediol+3.4 mol propylene oxide, aminated a) 1 mol 1,2-pentanediol+3.4 mol propylene oxide In a 2 l autoclave 208.3 g 1,2-pentanediol and 6.03 g potassium hydroxide (50% in water) were mixed and stirred under vacuum (<10 mbar) at 120° C. for 2 h. The autoclave was purged with nitrogen and heated to 140° C. 394.2 g propylene oxide was added in portions within 5 h. To complete the reaction, the mixture was allowed to post-react for additional 5 h at 140° C. The reaction mixture was stripped with nitrogen and volatile compounds were removed in vacuo at 80° C. Potassium hydroxide was removed by adding 18.1 g synthetic magnesium silicate (Macrosorb MP5plus, Ineos Silicas Ltd.). The mixture was stirred for 2 h at 90° C. and <10 mbar. After filtration 605.5 g of a light yellowish oil was obtained (hydroxy value: 336.3 mgKOH/g).

b) 1 mol 1,2-pentanediol+3.4 mol propylene oxide, aminated

In a 9 l autoclave 500.0 g of the resulting alkoxylated dialcohol from example 1-a, 1200 mL of THF and 1500.0 g of ammonia were mixed in the presence of 500 mL of a solid catalyst. The catalyst containing oxides of nickel, copper and molybdenum on zirconium dioxide was in the form of 3×3 mm tablets. The autoclave was purged with hydrogen and pressurized to 20 bar before the mixture was heated to 205° C. The pressure was increased to 280 bar and the reaction mixture was stirred for 15 hours at 205° C. and the total pressure was maintained at 280 bar. After 15 hours the autoclave was cooled to ambient temperature, the product was collected, filtered, and stripped on a rotary evaporator to remove light amines and water. A total of 450.0 g of a low-color polyetheramine mixture was isolated. The analytical results thereof are shown in Table 5.

TABLE 5

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 372.40 | 379.50 | 5.87 | 0.43 | 7.53 | 98.02 | 98.42 |

Example 6

1 mol 1,2-hexanediol+3.4 mol propylene oxide, aminated a) 1 mol 1,2-hexanediol+3.4 mol propylene oxide In a 2 l autoclave 236.3 g 1,2-hexanediol and 6.3 g potassium hydroxide (50% in water) were mixed and stirred under vacuum (<10 mbar) at 120° C. for 2 h. The autoclave was purged with nitrogen and heated to 140° C. 394.2 g propylene oxide was added in portions within 5 h. To complete the reaction, the mixture was allowed to post-react for additional 5 h at 140° C. The reaction mixture was stripped with nitrogen and volatile compounds were removed in vacuo at 80° C. Potassium hydroxide was removed by adding 19.0 g synthetic magnesium silicate (Macrosorb MP5plus, Ineos Silicas Ltd.). The mixture was stirred for 2 h at 90° C. and <10 mbar. After filtration 631.0 g of a light yellowish oil was obtained (hydroxy value: 315.4 mgKOH/g).

b) 1 mol 1,2-hexanediol+3.4 mol propylene oxide, aminated

In a 91 autoclave 500.0 g of the resulting alkoxylated dialcohol from example 2-a, 1200 mL of THF and 1500.0 g of ammonia were mixed in the presence of 200 mL of a solid catalyst. The catalyst containing oxides of nickel, copper and molybdenum on zirconium dioxide was in the form of 3×3 mm tablets. The autoclave was purged with hydrogen and pressurized to 20 bar before the mixture was heated to 205° C. The pressure was increased to 280 bar and the reaction mixture was stirred for 15 hours at 205° C. and the total pressure was maintained at 280 bar. After 15 hours the autoclave was cooled to ambient temperature, the product was collected, filtered, and stripped on a rotary evaporator to remove light amines and water. A total of 450.0 g of a low-color polyetheramine mixture was isolated. The analytical results thereof are shown in Table 6.

TABLE 6

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 350.40 | 357.50 | 7.03 | 1.85 | 8.95 | 97.51 | 97.99 |

Example 7

1 mol 1,2-octanediol+3.4 Mol propylene oxide, aminated a) 1 mol 1,2-octanediol+3.4 mol propylene oxide In a 2 l autoclave 248.6 g 1,2-octanediol and 5.8 g potassium hydroxide (50% in water) were mixed and stirred under vacuum (<10 mbar) at 120° C. for 2 h. The autoclave was purged with nitrogen and heated to 140° C. 335.2 g Propylene oxide was added in portions within 5 h. To complete the reaction, the mixture was allowed to post-react for additional 5 h at 140° C. The reaction mixture was stripped with nitrogen and volatile compounds were removed in vacuo at 80° C. Potassium hydroxide was removed by adding 17.5 g synthetic magnesium silicate (Macrosorb MP5plus, Ineos Silicas Ltd.). The mixture was stirred for 2 h at 90° C. and <10 mbar. After filtration 585.0 g of a yellowish oil was obtained (hydroxy value: 293.2 mgKOH/g).

b) 1 mol 1,2-octanediol+3.4 mol propylene oxide, aminated

In a 9 l autoclave 500 mL of the resulting alkoxylated dialcohol from example 3-a, 1200 mL of THF and 1500.0 g of ammonia were mixed in the presence of 200 mL of a solid catalyst. The catalyst containing oxides of nickel, copper and molybdenum on zirconium dioxide was in the form of 3×3 mm tablets. The autoclave was purged with hydrogen and pressurized to 20 bar before the mixture was heated to 205° C. The pressure was increased to 280 bar and the reaction mixture was stirred for 15 hours at 205° C. and the total pressure was maintained at 280 bar. After 15 hours the autoclave was cooled to ambient temperature, the product was collected, filtered, and stripped on a rotary evaporator to remove light amines and water. A total of 450.0 g of a low-color polyetheramine mixture was isolated. The analytical results thereof are shown in Table 7.

TABLE 7

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 299.20 | 308.40 | 6.68 | 1.19 | 10.39 | 96.64 | 97.77 |

Example 8

1 mol 1,2-decanediol+3.4 mol propylene oxide, aminated a) 1 mol 1,2-decanediol+3.4 mol propylene oxide In a 2 l autoclave 278.8 g 1,2-decanediol and 5.9 g potassium hydroxide (50% in water) were mixed and stirred under vacuum (<10 mbar) at 120° C. for 2 h. The autoclave was purged with nitrogen and heated to 140° C. 315.5 g Propylene oxide was added in portions within 5 h. To complete the reaction, the mixture was allowed to post-react for additional 5 h at 140° C. The reaction mixture was stripped with nitrogen and volatile compounds were removed in vacuo at 80° C. Potassium hydroxide was removed by adding 18.0 g synthetic magnesium silicate (Macrosorb MP5plus, Ineos Silicas Ltd.). The mixture was stirred for 2 h at 90° C. and <10 mbar. After filtration 595.0 g of a yellow oil was obtained (hydroxy value: 278.4 mgKOH/g).

b) 1 mol 1,2-decanediol+3.4 mol propylene oxide, aminated

In a 9 l autoclave 500 mL of the resulting alkoxylated dialcohol from example 4-a, 1200 mL of THF and 1500 g of ammonia were mixed in the presence of 200 mL of a solid catalyst. The catalyst containing oxides of nickel, copper and molybdenum on zirconium dioxide was in the form of 3×3 mm tablets. The autoclave was purged with hydrogen and pressurized to 20 bar before the mixture was heated to 205° C. The pressure was increased to 280 bar and the reaction mixture was stirred for 15 hours at 205° C. and the total pressure was maintained at 280 bar. After 15 hours the autoclave was cooled to ambient temperature, the product was collected, filtered, and stripped on a rotary evaporator to remove light amines and water. A total of 400 g of a low-color polyetheramine mixture was isolated. The analytical results thereof are shown in Table 8.

TABLE 8

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 319.15 | 328.00 | 6.90 | 0.73 | 9.58 | 97.09 | 97.84 |

Example 9

1 mol 1,2-dodecanediol+3.4 mol propylene oxide, aminated a) 1 mol 1,2-dodecanediol+3.4 mol propylene oxide In a 21 autoclave 337.2 g 1,2-dodecanediol and 6.0 g potassium hydroxide (50% in water) were mixed and stirred under vacuum (<10 mbar) at 120° C. for 2 h. The autoclave was purged with nitrogen and heated to 140° C. 295.8 g Propylene oxide was added in portions within 5 h. To complete the reaction, the mixture was allowed to post-react for additional 5 h at 140° C. The reaction mixture was stripped with nitrogen and volatile compounds were removed in vacuo at 80° C. Potassium hydroxide was removed by adding 19.1 g synthetic magnesium silicate (Macrosorb MP5plus, Ineos Silicas Ltd.). The mixture was stirred for 2 h at 90° C. and <10 mbar. After filtration 636.0 g of a yellow oil was obtained (hydroxy value: 275.5 mgKOH/g).

b) 1 mol 1,2-dodecanediol+3.4 mol propylene oxide, aminated

In a 91 autoclave 500 g of the resulting alkoxylated dialcohol from example 5-a, 1200 mL of THF and 1500 g of ammonia were mixed in the presence of 200 mL of a solid catalyst. The catalyst containing oxides of nickel, copper and molybdenum on zirconium dioxide was in the form of 3×3 mm tablets. The autoclave was purged with hydrogen and pressurized to 20 bar before the mixture was heated to 205° C. The pressure was increased to 280 bar and the reaction mixture was stirred for 15 hours at 205° C. and the total pressure was maintained at 280 bar. After 15 hours the autoclave was cooled to ambient temperature, the product was collected, filtered, and stripped on a rotary evaporator to remove light amines and water. A total of 450.0 g of a low-color polyetheramine mixture was isolated. The analytical results thereof are shown in Table 9.

TABLE 9

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 282.86 | 289.50 | 5.27 | 2.50 | 9.14 | 96.87 | 98.14 |

Generally, the degree of amination is from about 50% to about 100%, typically from about 60% to about 100%, and more typically from about 70% to about 100%.

The degree of amination is calculated from the total amine value (AZ) divided by sum of the total acetylables value (AC) and tertiary amine value (tert. AZ) multiplied by 100: (Total AZ: (AC+tert. AZ))×100). The total amine value (AZ) is determined according to DIN 16945. The total acetylables value (AC) is determined according to DIN 53240. The secondary and tertiary amine are determined according to ASTM D2074-07.

The hydroxyl value is calculated from (total acetylables value+tertiary amine value)-total amine value.

The polyetheramines of the invention are effective for removal of stains, particularly grease, from soiled material. Cleaning compositions containing the polyetheramines of the invention also do not exhibit the cleaning negatives seen with conventional amine-containing cleaning compositions on hydrophilic bleachable stains, such as coffee, tea, wine, or particulates. Additionally, unlike conventional amine-containing cleaning compositions, the polyetheramines of the invention do not contribute to whiteness negatives on white fabrics.

The polyetheramines of the invention may be used in the form of a water-based, water-containing, or water-free solution, emulsion, gel or paste of the polyetheramine together with an acid such as, for example, citric acid, lactic acid, sulfuric acid, methanesulfonic acid, hydrogen chloride, e.g., aqueous hydrogen chloride, phosphoric acid, or mixtures thereof. Alternatively, the acid may be represented by a surfactant, such as, alkyl benzene sulphonic acid, alkylsulphonic acid, monoalkyl esters of sulphuric acid, mono alkylethoxy esters of sulphuric acid, fatty acids, alkyl ethoxy carboxylic acids, and the like, or mixtures thereof. When applicable or measurable, the preferred pH of the solution or emulsion ranges from pH 3 to pH 11, or from pH 6 to pH 9.5, even more preferred from pH 7 to pH 8.5.

Tertiary dialkyl-substituted polyetheramines may be prepared from the respective primary polyetheramines by reductive amination. Typical procedures involve the use of formaldehyde or other alkylaldehydes, such as ethanal, 1-propanal or 1-butanal, in the presence of a hydrogen donor, such as formic acid, or the in the presence of hydrogen gas and a transition metal containing catalyst. Alternatively, dialky-substituted tertiary polyetheramines may be obtained by reacting a polyether alcohol with a dialkylamine, such as dimethylamine, in the presence of a suitable transition metal catalyst, typically in the additional presence of hydrogen and under continuous removal of the reaction water.

A further advantage of cleaning compositions containing the polyetheramines of the invention is their ability to remove grease stains in cold water, for example, via pretreatment of a grease stain followed by cold water washing. Without being limited by theory, it is believed that cold water washing solutions have the effect of hardening or solidifying grease, making the grease more resistant to removal, especially on fabric. Cleaning compositions containing the polyetheramines of the invention are surprisingly effective when used as part of a pretreatment regimen followed by cold water washing.

Surfactant

The cleaning composition may comprise one or more surfactants. The cleaning composition may comprise, by weight of the composition, from about 1% to about 70% of a surfactant. The cleaning composition may comprise, by weight of the composition, from about 2% to about 60% of the surfactant. The cleaning composition may comprise, by weight of the composition, from about 5% to about 30% of the surfactant. The surfactant may be selected from the group consisting of anionic surfactants, nonionic surfactants, cationic surfactants, zwitterionic surfactants, amphoteric surfactants, ampholytic surfactants, and mixtures thereof. The surfactant may be a detersive surfactant, which encompasses any surfactant or mixture of surfactants that provide cleaning, stain removing, or laundering benefit to soiled material.

Anionic Surfactants

The cleaning composition may comprise an anionic surfactant. The cleaning composition may consist essentially of, or even consist of, an anionic surfactant.

Specific, non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 25 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide. In yet further examples, the alkyl ether sulfate surfactant may contain a peaked ethoxylate distribution.

Non-alkoxylated alkyl sulfates may also be added to the disclosed detergent compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium. Other useful anionic surfactants can include the alkali metal salts of alkyl benzene sulfonates, in which the alkyl group contains from about 9 to about 15 carbon atoms, in straight chain (linear) or branched chain configuration. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS.

Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. A magnesium salt of LAS may be used.

The detersive surfactant may be a mid-chain branched detersive surfactant, e.g., a mid-chain branched anionic detersive surfactant, such as a mid-chain branched alkyl sulphate and/or a mid-chain branched alkyl benzene sulphonate.

Other anionic surfactants useful herein are the water-soluble salts of: paraffin sulfonates and secondary alkane sulfonates containing from about 8 to about 24 (and in some examples about 12 to 18) carbon atoms; alkyl glyceryl ether sulfonates, especially those ethers of $C_{8-18}$ alcohols (e.g., those derived from tallow and coconut oil). Mixtures of the alkylbenzene sulfonates with the above-described paraffin sulfonates, secondary alkane sulfonates and alkyl glyceryl ether sulfonates are also useful. Further suitable anionic surfactants include methyl ester sulfonates and alkyl ether carboxylates.

The anionic surfactants may exist in an acid form, and the acid form may be neutralized to form a surfactant salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

Nonionic Surfactants

The cleaning composition may comprise a nonionic surfactant. The cleaning composition may comprise from about 0.1% to about 50%, by weight of the cleaning composition, of a nonionic surfactant. The cleaning composition may comprise from about 0.1% to about 25% or about 0.1% to about 15%, by weight of the cleaning composition, of a nonionic surfactants. The cleaning composition may comprise from about 0.3% to about 10%, by weight of the cleaning composition, of a nonionic surfactant.

Suitable nonionic surfactants useful herein can comprise any conventional nonionic surfactant. These can include, for e.g., alkoxylated fatty alcohols and amine oxide surfactants. In some examples, the detergent compositions may contain an ethoxylated nonionic surfactant.

The nonionic surfactant may be selected from the ethoxylated alcohols and ethoxylated alkyl phenols of the formula $R(OC_2H_4)$—OH, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. The nonionic surfactant may be selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkyl alkoxylates, $BAE_x$, wherein x is from 1 to 30; alkylpolysaccharides; specifically alkylpolyglycosides; polyhydroxy fatty acid amides; and ether capped poly(oxyalkylated) alcohol surfactants.

Suitable nonionic detersive surfactants also include alkyl polyglucoside and alkyl alkoxylated alcohol. Suitable nonionic surfactants also include those sold under the tradename Lutensol® from BASF.

The nonionic surfactant may be selected from alkyl alkoxylated alcohols, such as a $C_{8-18}$ alkyl alkoxylated alcohol, for example, a $C_{8-18}$ alkyl ethoxylated alcohol. The alkyl alkoxylated alcohol may have an average degree of alkoxylation of from about 1 to about 50, or from about 1 to about 30, or from about 1 to about 20, or from about 1 to about 10, or from about 1 to about 7, or from about 1 to about 5, or from about 3 to about 7. The alkyl alkoxylated alcohol can be linear or branched, substituted or unsubstituted.

Cationic Surfactants

The cleaning composition may comprise a cationic surfactant. The cleaning composition may comprise from about 0.1% to about 10%, or from about 0.1% to about 7%, or from about 0.1% to about 5%, or from about 1% to about 4%, by weight of the cleaning composition, of a cationic surfactant. The cleaning compositions of the invention may be substantially free of cationic surfactants and surfactants that become cationic below a pH of 7 or below a pH of 6.

Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA).

Suitable cationic detersive surfactants also include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Zwitterionic Surfactants

The cleaning composition may comprise a zwitterionic surfactant. Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. Suitable examples of zwitterionic surfactants include betaines, including alkyl dimethyl betaine and cocodimethyl amidopropyl betaine, $C_8$ to $C_{18}$ (for example from $C_{12}$ to $C_{18}$) amine oxides, and sulfo and hydroxy betaines, such as N-alkyl-N,N-dimethylammino-1-propane sulfonate where the alkyl group can be $C_8$ to $C_{18}$.

Amphoteric Surfactants

The cleaning composition may comprise an amphoteric surfactant. Examples of amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Examples of compounds falling within this definition are sodium 3-(dodecylamino) propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Suitable amphoteric surfactants also include sarcosinates, glycinates, taurinates, and mixtures thereof.

Branched Surfactants

The cleaning composition may comprise a branched surfactant. Suitable branched surfactants include anionic branched surfactants selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups.

The branched detersive surfactant may be a mid-chain branched detersive surfactant, e.g., a mid-chain branched anionic detersive surfactant, such as a mid-chain branched alkyl sulphate and/or a mid-chain branched alkyl benzene sulphonate.

The branched surfactant may comprise a longer alkyl chain, mid-chain branched surfactant compound of the formula:

$$A_b\text{-X—B}$$

where:

(a) $A_b$ is a hydrophobic C9 to C22 (total carbons in the moiety), typically from about C12 to about C18, mid-chain branched alkyl moiety having: (1) a longest linear carbon chain attached to the —X—B moiety in the range of from 8 to 21 carbon atoms; (2) one or more C1-C3 alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—B moiety) to position ω-2 carbon (the terminal carbon minus 2 carbons, i.e., the third carbon from the end of the longest linear carbon chain); and (4) the surfactant composition has an average total number of carbon atoms in the $A_b$-X moiety in the above formula within the range of greater than 14.5 to about 17.5 (typically from about 15 to about 17);

b) B is a hydrophilic moiety selected from sulfates, sulfonates, amine oxides, polyoxyalkylene (such as polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, -amidopropyl betaines, alkylated quats, alkylated/polyhydroxyalkylated quats, alkylated/polyhydroxylated oxypropyl quats, imidazolines, 2-yl-succinates, sulfonated alkyl esters, and sulfonated fatty acids (it is to be noted that more than one hydrophobic moiety may be attached to B, for example as in $(A_b\text{-X})_z$—B to give dimethyl quats); and (c) X is selected from —CH2- and —C(O)—.

Generally, in the above formula the $A_b$ moiety does not have any quaternary substituted carbon atoms (i.e., 4 carbon atoms directly attached to one carbon atom). Depending on which hydrophilic moiety (B) is selected, the resultant surfactant may be anionic, nonionic, cationic, zwitterionic, amphoteric, or ampholytic. B may be a sulfate and the resultant surfactant may be anionic.

The branched surfactant may comprise a longer alkyl chain, mid-chain branched surfactant compound of the above formula wherein the $A_b$ moiety is a branched primary alkyl moiety having the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_z\text{-}$$

wherein the total number of carbon atoms in the branched primary alkyl moiety of this formula (including the R, $R^1$, and $R^2$ branching) is from 13 to 19; R, R1, and R2 are each independently selected from hydrogen and C1-C3 alkyl (typically methyl), provided R, R1, and R2 are not all hydrogen and, when z is 0, at least R or R1 is not hydrogen; w is an integer from 0 to 13; x is an integer from 0 to 13; y is an integer from 0 to 13; z is an integer from 0 to 13; and w+x+y+z is from 7 to 13.

The branched surfactant may comprise a longer alkyl chain, mid-chain branched surfactant compound of the above formula wherein the $A_b$ moiety is a branched primary alkyl moiety having the formula selected from:

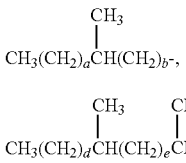

(I)

(II)

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

In the mid-chain branched surfactant compounds described above, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for mono-methyl branched alkyl $A^b$ moieties.

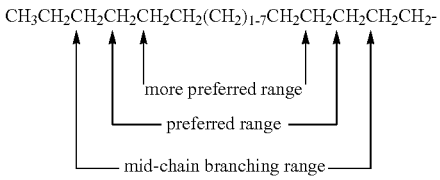

For mono-methyl substituted surfactants, these ranges exclude the two terminal carbon atoms of the chain and the carbon atom immediately adjacent to the —X—B group.

The formula below illustrates the mid-chain branching range, preferred mid-chain branching range, and more preferred mid-chain branching range for di-methyl substituted alkyl $A^b$ moieties.

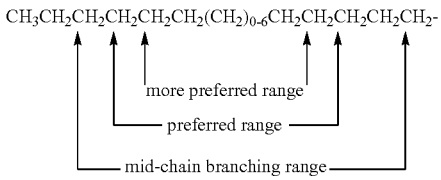

The branched anionic surfactant may comprise a branched modified alkylbenzene sulfonate (MLAS).

The branched anionic surfactant may comprise a C12/13 alcohol-based surfactant comprising a methyl branch randomly distributed along the hydrophobe chain, e.g., Safol®, Marlipal® available from Sasol.

Additional suitable branched anionic detersive surfactants include surfactant derivatives of isoprenoid-based poly-branched detergent alcohols. Further suitable branched anionic detersive surfactants include those derived from anteiso and iso-alcohols.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: $(R1)(R2)CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

Each of the branched surfactants described above may include a bio-based content. The branched surfactant may have a bio-based content of at least about 50%, at least about 60%, at least about 70%, at least about 80%, at least about 90%, at least about 95%, at least about 97%, or about 100%.

Anionic/Nonionic Combinations

The cleaning composition may comprise a combination of anionic and nonionic surfactants. The weight ratio of anionic surfactant to nonionic surfactant may be at least about 2:1. The weight ratio of anionic surfactant to nonionic surfactant may be at least about 5:1. The weight ratio of anionic surfactant to nonionic surfactant may be at least about 10:1.

Combinations of Surfactants

The cleaning composition may comprise an anionic surfactant and a nonionic surfactant, for example, a $C_{12}$-$C_{18}$ alkyl ethoxylate. The cleaning composition may comprise $C_{10}$-$C_{15}$ alkyl benzene sulfonates (LAS) and another anionic surfactant, e.g., $C_{10}$-$C_{18}$ alkyl alkoxy sulfates ($AE_xS$), where x is from 1-30. The cleaning composition may comprise an anionic surfactant and a cationic surfactant, for example, dimethyl hydroxyethyl lauryl ammonium chloride. The cleaning composition may comprise an anionic surfactant and a zwitterionic surfactant, for example, C12-C14 dimethyl amine oxide.

Adjunct Additives

The cleaning compositions of the invention may also contain adjunct additives. Suitable adjunct additives include builders, structurant or thickeners, clay soil removal/anti-redeposition agents, polymeric soil release agents, polymeric dispersing agents, polymeric grease cleaning agents, enzymes, enzyme stabilizing systems, bleaching compounds, bleaching agents, bleach activators, bleach catalysts, brighteners, dyes, hueing agents, dye transfer inhibiting agents, chelating agents, suds supressors, softeners, and perfumes.

Enzymes

The detergent compositions described herein may comprise one or more enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a detergent composition, the aforementioned additional enzymes may be present at levels from about 0.00001% to about 2%, from about 0.0001% to about 1% or even from about 0.001% to about 0.5% enzyme protein by weight of the detergent composition.

The enzyme may be a protease. Suitable proteases include metalloproteases and serine proteases, including neutral or alkaline microbial serine proteases, such as subtilisins (EC 3.4.21.62). Suitable proteases include those of animal, vegetable or microbial origin. A suitable protease may be of microbial origin. The suitable proteases include chemically or genetically modified mutants of the aforementioned suitable proteases. The suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii*.

(b) trypsin-type or chymotrypsin-type proteases, such as trypsin (e.g., of porcine or bovine origin), including the *Fusarium* protease and the chymotrypsin proteases derived from Cellumonas.

(c) metalloproteases, including those derived from *Bacillus amyloliquefaciens*.

Preferred proteases include those derived from *Bacillus gibsonii* or *Bacillus Lentus*.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (with mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375, DSM 12368, DSMZ no. 12649, KSM AP1378, KSM K36 or KSM K38. Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp.707 (SEQ ID NO:7 in U.S. Pat. No. 6,093,562), especially those comprising one or more of the following mutations M202, M208, 5255, R172, and/or M261. Preferably said amylase comprises one or more of M202L, M202V, M202S, M202T, M202I, M202Q, M202W, S255N and/or R172Q. Particularly preferred are those comprising the M202L or M202T mutations.

(e) variants described in WO 09/149130, preferably those exhibiting at least 90% identity with SEQ ID NO: 1 or SEQ ID NO:2 in WO 09/149130, the wild-type enzyme from *Geobacillus Stearophermophilus* or a truncated version thereof.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Suitable amylases include NATALASE®, STAINZYME® and STAINZYME PLUS® and mixtures thereof.

Such enzymes may be selected from the group consisting of: lipases, including "first cycle lipases". The lipase may be a first-wash lipase, e.g., a variant of the wild-type lipase from *Thermomyces lanuginosus* comprising one or more of the T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Preferred lipases would include those sold under the tradenames Lipex® and Lipolex®.

Other preferred enzymes include microbial-derived endoglucanases exhibiting endo-beta-1,4-glucanase activity (E.C. 3.2.1.4), including a bacterial polypeptide endogenous to a member of the genus *Bacillus* which has a sequence of at least 90%, 94%, 97% and even 99% identity to the amino acid sequence SEQ ID NO:2 in U.S. Pat. No. 7,141,403B2) and mixtures thereof. Suitable endoglucanases are sold under the tradenames Celluclean® and Whitezyme® (Novozymes A/S, Bagsvaerd, Denmark).

Other preferred enzymes include pectate lyases sold under the tradenames Pectawash®, Pectaway®, Xpect® and mannanases sold under the tradenames Mannaway® (all from Novozymes A/S, Bagsvaerd, Denmark), and Purabrite® (Genencor International Inc., Palo Alto, Calif.).

Enzyme Stabilizing System

The detergent compositions may optionally comprise from about 0.001% to about 10%, in some examples from about 0.005% to about 8%, and in other examples, from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the detergent composition. In the case of aqueous detergent compositions comprising protease, a reversible protease inhibitor, such as a boron compound, including borate, 4-formyl phenylboronic acid, phenylboronic acid and derivatives thereof, or compounds such as calcium formate, sodium formate and 1,2-propane diol may be added to further improve stability.

Builders

The detergent compositions of the present invention may optionally comprise a builder. Built detergent compositions typically comprise at least about 1% builder, based on the total weight of the composition. Liquid detergent compositions may comprise up to about 10% builder, and in some examples up to about 8% builder, of the total weight of the composition. Granular detergent compositions may comprise up to about 30% builder, and in some examples up to about 5% builder, by weight of the composition.

Builders selected from aluminosilicates (e.g., zeolite builders, such as zeolite A, zeolite P, and zeolite MAP) and silicates assist in controlling mineral hardness in wash water, especially calcium and/or magnesium, or to assist in the removal of particulate soils from surfaces. Suitable builders may be selected from the group consisting of phosphates, such as polyphosphates (e.g., sodium tri-polyphosphate), especially sodium salts thereof; carbonates, bicarbonates, sesquicarbonates, and carbonate minerals other than sodium carbonate or sesquicarbonate; organic mono-, di-, tri-, and tetracarboxylates, especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions. Additional suitable builders may be selected from citric acid, lactic acid, fatty acid, polycarboxylate builders, for example, copolymers of acrylic acid, copolymers of acrylic acid and maleic acid, and copolymers of acrylic acid and/or maleic acid, and other suitable ethylenic monomers with various types of additional functionalities. Also suitable for use as builders herein are synthesized crystalline ion exchange materials or hydrates thereof having chain structure and a composition represented by the following general anhydride form: $x(M_2O).ySiO_2.zM'O$ wherein M is Na and/or K, M' is Ca and/or Mg; y/x is 0.5 to 2.0; and z/x is 0.005 to 1.0 as taught in U.S. Pat. No. 5,427,711.

Alternatively, the composition may be substantially free of builder.

Structurant/Thickeners i. Di-benzylidene Polyol Acetal Derivative

The fluid detergent composition may comprise from about 0.01% to about 1% by weight of a dibenzylidene polyol acetal derivative (DBPA), or from about 0.05% to about 0.8%, or from about 0.1% to about 0.6%, or even from about 0.3% to about 0.5%. The DBPA derivative may comprise a dibenzylidene sorbitol acetal derivative (DBS). Said DBS derivative may be selected from the group consisting of: 1,3:2,4-dibenzylidene sorbitol; 1,3:2,4-di(p-methylbenzylidene) sorbitol; 1,3:2,4-di(p-chlorobenzylidene) sorbitol; 1,3:2,4-di(2,4-dimethyldibenzylidene) sorbitol; 1,3:2,4-di(p-ethylbenzylidene) sorbitol; and 1,3:2,4-di(3,4-dimethyldibenzylidene) sorbitol or mixtures thereof.

ii. Bacterial Cellulose

The fluid detergent composition may also comprise from about 0.005% to about 1% by weight of a bacterial cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like. The fibres may have cross sectional dimensions of 1.6 nm to 3.2 nm by 5.8 nm to 133 nm. Additionally, the bacterial cellulose fibres have an average microfibre length of at least about 100 nm, or from about 100 to about 1,500 nm. The bacterial cellulose microfibers may have an aspect ratio, meaning the average microfibre length divided by the widest cross sectional microfibre width, of from about 100:1 to about 400:1, or even from about 200:1 to about 300:1.

iii. Coated Bacterial Cellulose

The bacterial cellulose may be at least partially coated with a polymeric thickener. The at least partially coated bacterial cellulose may comprise from about 0.1% to about 5%, or even from about 0.5% to about 3%, by weight of bacterial cellulose; and from about 10% to about 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

iv. Cellulose Fibers Non-Bacterial Cellulose Derived

The composition may further comprise from about 0.01 to about 5% by weight of the composition of a cellulosic fiber. Said cellulosic fiber may be extracted from vegetables, fruits or wood. Commercially available examples are Avicel® from FMC, Citri-Fi from Fiberstar or Betafib from Cosun.

v. Non-Polymeric Crystalline Hydroxyl-Functional Materials

The composition may further comprise from about 0.01 to about 1% by weight of the composition of a non-polymeric crystalline, hydroxyl functional structurant. Said non-polymeric crystalline, hydroxyl functional structurants generally may comprise a crystallizable glyceride which can be pre-emulsified to aid dispersion into the final fluid detergent composition. Crystallizable glycerides may include hydrogenated castor oil or "HCO" or derivatives thereof, provided that it is capable of crystallizing in the liquid detergent composition.

vi. Polymeric Structuring Agents

Fluid detergent compositions of the present invention may comprise from about 0.01% to about 5% by weight of a naturally derived and/or synthetic polymeric structurant. Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of synthetic polymeric structurants of use in the present invention include: polycarboxylates, polyacrylates, hydrophobically modified ethoxylated urethanes, hydrophobically modified non-ionic polyols and mixtures thereof. The polycarboxylate polymer may be a polyacrylate, polymethacrylate or mixtures thereof. The polyacrylate may be a copolymer of unsaturated mono- or di-carbonic acid and $C_1$-$C_{30}$ alkyl ester of the (meth)acrylic acid. Said copolymers are available from Noveon inc under the tradename Carbopol Aqua 30.

vii. Di-Amido-Gellants

The external structuring system may comprise a di-amido gellant having a molecular weight from about 150 g/mol to about 1,500 g/mol, or even from about 500 g/mol to about 900 g/mol. Such di-amido gellants may comprise at least two nitrogen atoms, wherein at least two of said nitrogen atoms form amido functional substitution groups. The amido groups may be different. The amido functional groups may be the same. The di-amido gellant has the following formula:

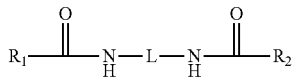

wherein:

$R_1$ and $R_2$ is an amino functional end-group, or even amido functional end-group, or $R_1$ and $R_2$ may comprise a pH-tuneable group, wherein the pH tuneable amido-gellant may have a pKa of from about 1 to about 30, or even from about 2 to about 10. The pH tuneable group may comprise a pyridine. $R_1$ and $R_2$ may be different. $R_1$ and $R_2$ may be the same.

L is a linking moeity of molecular weight from 14 to 500 g/mol. L may comprise a carbon chain comprising between 2 and 20 carbon atoms. L may comprise a pH-tuneable group. The pH tuneable group may be a secondary amine. At least one of $R_1$, $R_2$ or L may comprise a pH-tuneable group.

Non-limiting examples of di-amido gellants are:

N,N'-(2S,2'S)-1,1'-(dodecane-1,12-diylbis(azanediyl))bis(3-methyl-1-oxobutane-2,1-diyl)diisonicotinamide

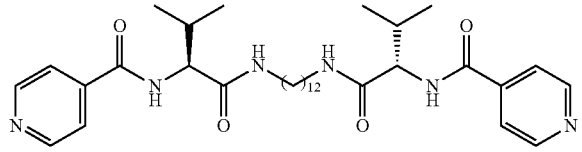

dibenzyl (2S,2'S)-1,1'-(propane-1,3-diylbis(azanediyl))bis(3-methyl-1-oxobutane-2,1-diyl)dicarbamate

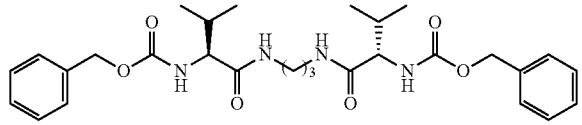

dibenzyl (2S,2'S)-1,1'-(dodecane-1,12-diylbis(azanediyl))bis(1-oxo-3-phenylpropane-2,1-diyl)dicarbamate

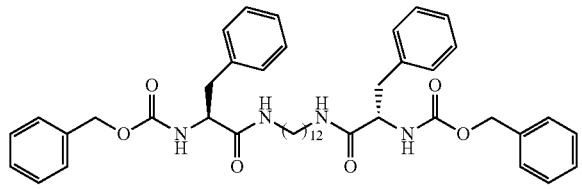

Polymeric Dispersing Agents

The detergent composition may comprise one or more polymeric dispersing agents. Examples are carboxymethylcellulose, poly(vinyl-pyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid co-polymers.

The detergent composition may comprise one or more amphiphilic cleaning polymers such as the compound having the following general structure: bis(($C_2H_5O$)($C_2H_4O$)n)($CH_3$)—$N^+$—$C_xH_{2x}$—$N^+$—($CH_3$)-bis(($C_2H_5O$)($C_2H_4O$)n), wherein n=from 20 to 30, and x=from 3 to 8, or sulphated or sulphonated variants thereof.

The detergent composition may comprise amphiphilic alkoxylated grease cleaning polymers which have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkylenimines, for example, having an inner polyethylene oxide block and an outer polypropylene oxide block. Such compounds may include, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The detergent compositions described herein may comprise from about 0.1% to about 10%, and in some examples, from about 0.1% to about 8%, and in other examples, from about 0.1% to about 6%, by weight of the detergent composition, of alkoxylated polyamines.

Carboxylate polymer—The detergent composition of the present invention may also include one or more carboxylate polymers, which may optionally be sulfonated. Suitable carboxylate polymers include a maleate/acrylate random copolymer or a poly(meth)acrylate homopolymer. The carboxylate polymer may be a poly(meth)acrylate homopolymer having a molecular weight from 4,000 Da to 9,000 Da, or from 6,000 Da to 9,000 Da.

Alkoxylated polycarboxylates may also be used in the detergent compositions herein to provide grease removal. Such materials are described in WO 91/08281 and PCT 90/01815. Chemically, these materials comprise poly(meth) acrylates having one ethoxy side-chain per every 7-8 (meth) acrylate units. The side-chains are of the formula $—(CH_2CH_2O)_m\ (CH_2)—CH_3$ wherein m is 2-3 and n is 6-12. The side-chains are ester-linked to the polyacrylate "backbone" to provide a "comb" polymer type structure. The molecular weight can vary, but may be in the range of about 2000 to about 50,000. The detergent compositions described herein may comprise from about 0.1% to about 10%, and in some examples, from about 0.25% to about 5%, and in other examples, from about 0.3% to about 2%, by weight of the detergent composition, of alkoxylated polycarboxylates.

The detergent compositions may include an amphiphilic graft co-polymer. A suitable amphiphilic graft co-polymer comprises (i) a polyethyelene glycol backbone; and (ii) and at least one pendant moiety selected from polyvinyl acetate, polyvinyl alcohol and mixtures thereof. A suitable amphilic graft co-polymer is Sokalan® HP22, supplied from BASF. Suitable polymers include random graft copolymers, preferably a polyvinyl acetate grafted polyethylene oxide copolymer having a polyethylene oxide backbone and multiple polyvinyl acetate side chains. The molecular weight of the polyethylene oxide backbone is typically about 6000 and the weight ratio of the polyethylene oxide to polyvinyl acetate is about 40 to 60 and no more than 1 grafting point per 50 ethylene oxide units.

Soil Release Polymer

The detergent compositions of the present invention may also include one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Cellulosic Polymer

The cleaning compositions of the present invention may also include one or more cellulosic polymers including those selected from alkyl cellulose, alkyl alkoxyalkyl cellulose, carboxyalkyl cellulose, alkyl carboxyalkyl cellulose. The cellulosic polymers may be selected from the group comprising carboxymethyl cellulose, methyl cellulose, methyl hydroxyethyl cellulose, methyl carboxymethyl cellulose, and mixtures thereof. The carboxymethyl cellulose may have a degree of carboxymethyl substitution from 0.5 to 0.9 and a molecular weight from 100,000 Da to 300,000 Da.

Examples of polymeric dispersing agents are found in U.S. Pat. No. 3,308,067, European Patent Application No. 66915, EP 193,360, and EP 193,360.

Additional Amines

Additional amines may be used in the cleaning compositions described herein for added removal of grease and particulates from soiled materials. The detergent compositions described herein may comprise from about 0.1% to about 10%, in some examples, from about 0.1% to about 4%, and in other examples, from about 0.1% to about 2%, by weight of the detergent composition, of additional amines. Non-limiting examples of additional amines may include, but are not limited to, polyetheramines, polyamines, oligoamines, triamines, diamines, pentamines, tetraamines, or combinations thereof. Specific examples of suitable additional amines include tetraethylenepentamine, triethylenetetraamine, diethylenetriamine, or a mixture thereof.

Bleaching Agents—

The detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the detergent compositions of the present invention may comprise from about 0.1% to about 50% or even from about 0.1% to about 25% bleaching agent by weight of the detergent composition. Examples of suitable bleaching agents include: photobleaches; preformed peracids; sources of hydrogen peroxide; bleach activators having R—(C═O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS).

Bleach Catalysts—

The detergent compositions of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Brighteners Optical brighteners or other brightening or whitening agents may be incorporated at levels of from about 0.01% to about 1.2%, by weight of the composition, into the detergent compositions described herein. Commercial fluorescent brighteners suitable for the present invention can be classified into subgroups, including but not limited to: derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Specific nonlimiting examples of optical brighteners which are useful in the present compositions are those identified in U.S. Pat. No. 4,790,856,U.S. Pat. No. 3,646,015 U.S. Pat. No. 7,863,236 and its CN equivalent No. 1764714.

In some examples, the fluorescent brightener herein comprises a compound of formula (1):

(1)

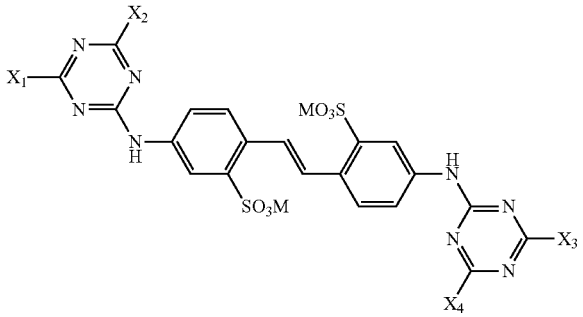

wherein: $X_1$, $X_2$, $X_3$, and $X_4$ are —N($R^1$)$R^2$, wherein $R^1$ and $R^2$ are independently selected from a hydrogen, a phenyl, hydroxyethyl, or an unsubstituted or substituted $C_1$-$C_8$ alkyl, or —N($R^1$)$R^2$ form a heterocyclic ring, preferably $R^1$ and $R^2$ are independently selected from a hydrogen or phenyl, or —N($R^1$)$R^2$ form a unsubstituted or substituted morpholine ring; and M is a hydrogen or a cation, preferably M is sodium or potassium, more preferably M is sodium.

In some examples, the fluorescent brightener is selected from the group consisting of disodium-4,4'-bis{[4-anilino-6-morpholino-s-triazin-2-yl]-amino}-2,2'-stilbenedisulfonate (brightener 15, commercially available under the tradename Tinopal AMS-GX by Ciba Geigy Corporation),-disodium4,4'-bis{[4-anilino-6-(N-2-bis-hydroxyethyl)-s-triazine-2-yl]-amino}-2,2'-stilbenedisulonate (commercially available under the tradename Tinopal UNPA-GX by Ciba-Geigy Corporation), disodium 4,4'-bis{[4-anilino-6-(N-2-hydroxyethyl-N-methylamino)-s-triazine-2-yl]-amino}-2,2'-stilbenedisulfonate (commercially available under the tradename Tinopal 5BM-GX by Ciba-Geigy Corporation). More preferably, the fluorescent brightener is disodium 4,4'-bis{[4-anilino-6-morpholino-s-triazin-2-yl]-amino}-2,2'-stilbenedisulfonate. The brighteners may be added in particulate form or as a premix with a suitable solvent, for example nonionic surfactant, monoethanolamine, propane diol.

Fabric Hueing Agents

The composition may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. Suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes, and mixtures thereof. Suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. Suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

Suitable dye clay conjugates include dye clay conjugates selected from the group comprising at least one cationic/basic dye and a smectite clay, and mixtures thereof. Suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. Suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

Suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Encapsulates

The compositions may comprise an encapsulate. The encapsulate may comprise a core, a shell having an inner and outer surface, where the shell encapsulates the core.

The encapsulate may comprise a core and a shell, where the core comprises a material selected from perfumes; brighteners; dyes; insect repellants; silicones; waxes; flavors; vitamins; fabric softening agents; skin care agents, e.g., paraffins; enzymes; anti-bacterial agents; bleaches; sensates; or mixtures thereof; and where the shell comprises a material selected from polyethylenes; polyamides; polyvinylalcohols, optionally containing other co-monomers; polystyrenes; polyisoprenes; polycarbonates; polyesters; polyacrylates; polyolefins; polysaccharides, e.g., alginate and/or chitosan; gelatin; shellac; epoxy resins; vinyl polymers; water insoluble inorganics; silicone; aminoplasts, or mixtures thereof. When the shell comprises an aminoplast, the aminoplast may comprise polyurea, polyurethane, and/or polyureaurethane. The polyurea may comprise polyoxymethyleneurea and/or melamine formaldehyde.

The encapsulate may comprise a core, and the core may comprise a perfume. The encapsulate may comprise a shell, and the shell may comprise melamine formaldehyde and/or cross linked melamine formaldehyde. The encapsulate may comprise a core comprising a perfume and a shell comprising melamine formaldehyde and/or cross linked melamine formaldehyde Suitable encapsulates may comprise a core material and a shell, where the shell at least partially surrounds the core material. At least 75%, or at least 85%, or even at least 90% of the encapsulates may have a fracture strength of from about 0.2 MPa to about 10 MPa, from about 0.4 MPa to about 5 MPa, from about 0.6 MPa to about 3.5 MPa, or even from about 0.7 MPa to about 3 MPa; and a benefit agent leakage of from 0% to about 30%, from 0% to about 20%, or even from 0% to about 5%.

At least 75%, 85% or even 90% of said encapsulates may have a particle size of from about 1 microns to about 80 microns, about 5 microns to 60 microns, from about 10 microns to about 50 microns, or even from about 15 microns to about 40 microns.

At least 75%, 85% or even 90% of said encapsulates may have a particle wall thickness of from about 30 nm to about 250 nm, from about 80 nm to about 180 nm, or even from about 100 nm to about 160 nm.

The core of the encapsulate comprises a material selected from a perfume raw material and/or optionally a material selected from vegetable oil, including neat and/or blended vegetable oils including caster oil, coconut oil, cottonseed oil, grape oil, rapeseed, soybean oil, corn oil, palm oil, linseed oil, safflower oil, olive oil, peanut oil, coconut oil, palm kernel oil, castor oil, lemon oil and mixtures thereof; esters of vegetable oils, esters, including dibutyl adipate, dibutyl phthalate, butyl benzyl adipate, benzyl octyl adipate, tricresyl phosphate, trioctyl phosphate and mixtures thereof; straight or branched chain hydrocarbons, including those straight or branched chain hydrocarbons having a boiling point of greater than about 80° C.; partially hydrogenated terphenyls, dialkyl phthalates, alkyl biphenyls, including monoisopropylbiphenyl, alkylated naphthalene, including dipropylnaphthalene, petroleum spirits, including kerosene, mineral oil or mixtures thereof; aromatic solvents, including benzene, toluene or mixtures thereof; silicone oils; or mixtures thereof.

The wall of the encapsulate may comprise a suitable resin, such as the reaction product of an aldehyde and an amine. Suitable aldehydes include formaldehyde. Suitable amines include melamine, urea, benzoguanamine, glycoluril, or mixtures thereof. Suitable melamines include methylol melamine, methylated methylol melamine, imino melamine and mixtures thereof. Suitable ureas include, dimethylol urea, methylated dimethylol urea, urea-resorcinol, or mixtures thereof.

Suitable formaldehyde scavengers may be employed with the encapsulates, for example, in a capsule slurry and/or added to a composition before, during, or after the encapsulates are added to such composition.

Suitable capsules can be purchased from Appleton Papers Inc. of Appleton, Wis. USA.

In addition, the materials for making the aforementioned encapsulates can be obtained from Solutia Inc. (St Louis, Mo. U.S.A.), Cytec Industries (West Paterson, N.J. U.S.A.), sigma-Aldrich (St. Louis, Mo. U.S.A.), CP Kelco Corp. of San Diego, Calif., USA; BASF AG of Ludwigshafen, Germany; Rhodia Corp. of Cranbury, N.J., USA; Hercules Corp. of Wilmington, Del., USA; Agrium Inc. of Calgary, Alberta, Canada, ISP of New Jersey U.S.A., Akzo Nobel of Chicago, Ill., USA; Stroever Shellac Bremen of Bremen, Germany; Dow Chemical Company of Midland, Mich., USA; Bayer AG of Leverkusen, Germany; Sigma-Aldrich Corp., St. Louis, Mo., USA.

Perfumes

Perfumes and perfumery ingredients may be used in the detergent compositions described herein. Non-limiting examples of perfume and perfumery ingredients include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes may be included at a concentration ranging from about 0.01% to about 2% by weight of the detergent composition.

Dye Transfer Inhibiting Agents

Fabric detergent compositions may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.0001% to about 10%, by weight of the composition, in some examples, from about 0.01% to about 5%, by weight of the composition, and in other examples, from about 0.05% to about 2% by weight of the composition.

Chelating Agents

The detergent compositions described herein may also contain one or more metal ion chelating agents. Suitable molecules include copper, iron and/or manganese chelating agents and mixtures thereof. Such chelating agents can be selected from the group consisting of phosphonates, amino carboxylates, amino phosphonates, succinates, polyfunctionally-substituted aromatic chelating agents, 2-pyridinol-N-oxide compounds, hydroxamic acids, carboxymethyl inulins and mixtures thereof. Chelating agents can be present in the acid or salt form including alkali metal, ammonium, and substituted ammonium salts thereof, and mixtures thereof.

Other suitable chelating agents for use herein are the commercial DEQUEST series, and chelants from Monsanto, Akzo-Nobel, DuPont, Dow, the Trilon® series from BASF and Nalco.

The chelant may be present in the detergent compositions disclosed herein at from about 0.005% to about 15% by weight, about 0.01% to about 5% by weight, about 0.1% to about 3.0% by weight, or from about 0.2% to about 0.7% by weight, or from about 0.3% to about 0.6% by weight of the detergent compositions disclosed herein.

Suds Suppressors

Compounds for reducing or suppressing the formation of suds can be incorporated into the detergent compositions described herein. Suds suppression can be of particular importance in the so-called "high concentration cleaning process" and in front-loading style washing machines.

A wide variety of materials may be used as suds suppressors, and suds suppressors are well known to those skilled in the art. Examples of suds supressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons preferably having a melting point below about 100° C., silicone suds suppressors, and secondary alcohols.

Additional suitable antifoams are those derived from phenylpropylmethyl substituted polysiloxanes.

In certain examples, the detergent composition comprises a suds suppressor selected from organomodified silicone polymers with aryl or alkylaryl substituents combined with silicone resin and a primary filler, which is modified silica. The detergent compositions may comprise from about 0.001% to about 4.0%, by weight of the composition, of such a suds suppressor. In further examples, the detergent composition comprises a suds suppressor selected from: a) mixtures of from about 80 to about 92% ethylmethyl, methyl(2-phenylpropyl) siloxane; from about 5 to about 14% MQ resin in octyl stearate; and from about 3 to about 7% modified silica; b) mixtures of from about 78 to about 92% ethylmethyl, methyl(2-phenylpropyl) siloxane; from about 3 to about 10% MQ resin in octyl stearate; from about 4 to about 12% modified silica; or c) mixtures thereof, where the percentages are by weight of the anti-foam.

The detergent compositions herein may comprise from 0.1% to about 10%, by weight of the composition, of suds suppressor. When utilized as suds suppressors, monocarboxylic fatty acids, and salts thereof, may be present in amounts of up to about 5% by weight of the detergent composition, and in some examples, from about 0.5% to about 3% by weight of the detergent composition. Silicone suds suppressors may be utilized in amounts of up to about 2.0% by weight of the detergent composition, although higher amounts may be used. Monostearyl phosphate suds suppressors may be utilized in amounts ranging from about 0.1% to about 2% by weight of the detergent composition. Hydrocarbon suds suppressors may be utilized in amounts ranging from about 0.01% to about 5.0% by weight of the detergent composition, although higher levels can be used. Alcohol suds suppressors may be used at a concentration ranging from about 0.2% to about 3% by weight of the detergent composition.

Suds Boosters

If high sudsing is desired, suds boosters such as the $C_{10}$-$C_{16}$ alkanolamides may be incorporated into the detergent compositions at a concentration ranging from about 1% to about 10% by weight of the detergent composition. Some examples include the $C_{10}$-$C_{14}$ monoethanol and diethanol amides. If desired, water-soluble magnesium and/or calcium salts such as $MgCl_2$, $MgSO_4$, $CaCl_2$, $CaSO_4$, and the like, may be added at levels of about 0.1% to about 2% by weight of the detergent composition, to provide additional suds and to enhance grease removal performance.

Conditioning Agents

The composition of the present invention may include a high melting point fatty compound. The high melting point fatty compound useful herein has a melting point of 25° C. or higher, and is selected from the group consisting of fatty alcohols, fatty acids, fatty alcohol derivatives, fatty acid derivatives, and mixtures thereof. Such compounds of low melting point are not intended to be included in this section.

The high melting point fatty compound is included in the composition at a level of from about 0.1% to about 40%, preferably from about 1% to about 30%, more preferably from about 1.5% to about 16% by weight of the composition, from about 1.5% to about 8%.

The composition of the present invention may include a nonionic polymer as a conditioning agent.

Suitable conditioning agents for use in the composition include those conditioning agents characterized generally as silicones (e.g., silicone oils, cationic silicones, silicone gums, high refractive silicones, and silicone resins), organic conditioning oils (e.g., hydrocarbon oils, polyolefins, and fatty esters) or combinations thereof, or those conditioning agents which otherwise form liquid, dispersed particles in the aqueous surfactant matrix herein. The concentration of the silicone conditioning agent typically ranges from about 0.01% to about 10%.

The compositions of the present invention may also comprise from about 0.05% to about 3% of at least one organic conditioning oil as the conditioning agent, either alone or in combination with other conditioning agents, such as the silicones (described herein). Suitable conditioning oils include hydrocarbon oils, polyolefins, and fatty esters.

Fabric Enhancement Polymers

Suitable fabric enhancement polymers are typically cationically charged and/or have a high molecular weight.

Suitable concentrations of this component are in the range from 0.01% to 50%, preferably from 0.1% to 15%, more preferably from 0.2% to 5.0%, and most preferably from 0.5% to 3.0% by weight of the composition. The fabric enhancement polymers may be a homopolymer or be formed from two or more types of monomers. The monomer weight of the polymer will generally be between 5,000 and 10,000,000, typically at least 10,000 and preferably in the range 100,000 to 2,000,000. Preferred fabric enhancement polymers will have cationic charge densities of at least 0.2 meq/gm, preferably at least 0.25 meq/gm, more preferably at least 0.3 meq/gm, but also preferably less than 5 meq/gm, more preferably less than 3 meq/gm, and most preferably less than 2 meq/gm at the pH of intended use of the composition, which pH will generally range from pH 3 to pH 9, preferably between pH 4 and pH 8.

The fabric enhancement polymers may be of natural or synthetic origin. Preferred fabric enhancement polymers may be selected from the group consisting of substituted and unsubstituted polyquaternary ammonium compounds, cationically modified polysaccharides, cationically modified (meth)acrylamide polymers/copolymers, cationically modified (meth)acrylate polymers/copolymers, chitosan, quaternized vinylimidazole polymers/copolymers, dimethyldiallylammonium polymers/copolymers, polyethylene imine based polymers, cationic guar gums, and derivatives thereof and combinations thereof.

Other fabric enhancement polymers suitable for the use in the compositions of the present invention include, for example: a) copolymers of 1-vinyl-2-pyrrolidine and 1-vinyl-3-methyl-imidazolium salt (e.g. chloride alt), referred to in the industry by the Cosmetic, Toiletry, and Fragrance Association, (CTFA) as Polyquaternium-16; b) copolymers of 1-vinyl-2-pyrrolidine and dimethylaminoethyl methacrylate, referred to in the industry (CTFA) as Polyquaternium-11; c) cationic diallyl quaternary ammonium-containing polymers including, for example, dimethyldiallylammonium chloride homopolymer and copolymers of acrylamide and dimethyldiallylammonium chloride, reffered to in the industry (CTFA) as Polyquaternium 6 and Polyquaternium 7, respectively; d) mineral acid salts of amino-alkyl esters of homo- and copolymers of unsaturated carboxylic acids having from 3 to 5 carbon atoms, amphoteric copolymers of acrylic acid including copolymers of acrylic acid and dimethyldiallylammonium chloride (referred to in the industry by CTFA as Polyquaternium 22), terpolymers of acrylic acid with dimethyldiallylammonium chloride and acrylamide (referred to in the industry by CTFA as Polyquaternium 39), and terpolymers of acrylic acid with methacrylamidopropyl trimethylammonium chloride and methylacrylate (referred to in the industry by CTFA as Polyquaternium 47).

Other fabric enhancement polymers suitable in the compositions of the present invention include cationic polysaccharide polymers, such as cationic cellulose and derivatives thereof, cationic starch and derivatives thereof, and cationic guar gums and derivatives thereof. Other suitable cationic polysaccharide polymers include quaternary nitrogen-containing cellulose ethers and copolymers of etherified cellulose and starch. A suitable type of cationic polysaccharide polymer that can be used is a cationic guar gum derivative, such as the cationic polygalactomannan gum derivatives.

Pearlescent Agent

The laundry detergent compositions of the invention may comprise a pearlescent agent. Non-limiting examples of pearlescent agents include: mica; titanium dioxide coated mica; bismuth oxychloride; fish scales; mono and diesters of alkylene glycol of the formula:

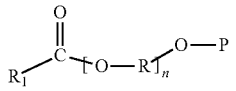

wherein:

a. R1 is linear or branched C12-C22 alkyl group;

b. R is linear or branched C2-C4 alkylene group;

c. P is selected from H; C1-C4 alkyl; or $COR_2$; and d. n=1-3.

The pearlescent agent may be ethyleneglycoldistearate (EGDS).

Hygiene and Malodour

The compositions of the present invention may also comprise one or more of zinc ricinoleate, thymol, quaternary ammonium salts such as Bardac®, polyethylenimines (such as Lupasol® from BASF) and zinc complexes thereof, silver and silver compounds, especially those designed to slowly release $Ag^+$ or nano-silver dispersions.

Fillers and Carriers

Fillers and carriers may be used in the detergent compositions described herein. As used herein, the terms "filler" and "carrier" have the same meaning and can be used interchangeably.

Liquid detergent compositions and other forms of detergent compositions that include a liquid component (such as liquid-containing unit dose detergent compositions) may contain water and other solvents as fillers or carriers. Suitable solvents also include lipophilic fluids, including siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, and mixtures thereof.

Low molecular weight primary or secondary alcohols exemplified by methanol, ethanol, propanol, and isopropanol are suitable. Monohydric alcohols may be used in some examples for solubilizing surfactants, and polyols such as those containing from 2 to about 6 carbon atoms and from 2 to about 6 hydroxy groups (e.g., 1,3-propanediol, ethylene glycol, glycerine, and 1,2-propanediol) may also be used. Amine-containing solvents, such as monoethanolamine, diethanolamine and triethanolamine, may also be used.

The detergent compositions may contain from about 5% to about 90%, and in some examples, from about 10% to about 50%, by weight of the composition, of such carriers. For compact or super-compact heavy duty liquid or other forms of detergent compositions, the use of water may be lower than about 40% by weight of the composition, or lower than about 20%, or lower than about 5%, or less than about 4% free water, or less than about 3% free water, or less than about 2% free water, or substantially free of free water (i.e., anhydrous).

For powder or bar detergent compositions, or forms that include a solid or powder component (such as powder-containing unit dose detergent composition), suitable fillers may include, but are not limited to, sodium sulfate, sodium chloride, clay, or other inert solid ingredients. Fillers may also include biomass or decolorized biomass. Fillers in granular, bar, or other solid detergent compositions may comprise less than about 80% by weight of the detergent composition, and in some examples, less than about 50% by weight of the detergent composition. Compact or supercompact powder or solid detergent compositions may comprise less than about 40% filler by weight of the detergent composition, or less than about 20%, or less than about 10%.

For either compacted or supercompacted liquid or powder detergent compositions, or other forms, the level of liquid or solid filler in the product may be reduced, such that either the same amount of active chemistry is delivered to the wash liquor as compared to noncompacted detergent compositions, or in some examples, the detergent composition is more efficient such that less active chemistry is delivered to the wash liquor as compared to noncompacted compositions. For example, the wash liquor may be formed by contacting the detergent composition to water in such an amount so that the concentration of detergent composition in the wash liquor is from above 0 g/l to 6 g/l. In some examples, the concentration may be from about 0.5 g/l to about 5 g/l, or to about 3.0 g/l, or to about 2.5 g/l, or to about 2.0 g/l, or to about 1.5 g/l, or from about 0 g/l to about 1.0 g/l, or from about 0 g/l to about 0.5 g/l. These dosages are not intended to be limiting, and other dosages may be used that will be apparent to those of ordinary skill in the art.

Buffer System

The detergent compositions described herein may be formulated such that, during use in aqueous cleaning operations, the wash water will have a pH of between about 7.0 and about 12, and in some examples, between about 7.0 and about 11. Techniques for controlling pH at recommended usage levels include the use of buffers, alkalis, or acids, and are well known to those skilled in the art. These include, but are not limited to, the use of sodium carbonate, citric acid or sodium citrate, lactic acid or lactate, monoethanol amine or other amines, boric acid or borates, and other pH-adjusting compounds well known in the art.

The detergent compositions herein may comprise dynamic in-wash pH profiles. Such detergent compositions may use wax-covered citric acid particles in conjunction with other pH control agents such that (i) about 3 minutes after contact with water, the pH of the wash liquor is greater than 10; (ii) about 10 minutes after contact with water, the pH of the wash liquor is less than 9.5; (iii) about 20 minutes after contact with water, the pH of the wash liquor is less than 9.0; and (iv) optionally, wherein, the equilibrium pH of the wash liquor is in the range of from about 7.0 to about 8.5.

Catalytic Metal Complexes

The detergent compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof.

Water-Soluble Film

The compositions of the present invention may also be encapsulated within a water-soluble film. Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material.

Naturally, different film material and/or films of different thickness may be employed in making the compartments of the present invention. A benefit in selecting different films is that the resulting compartments may exhibit different solubility or release characteristics.

Suitable film materials are PVA films known under the MonoSol trade reference M8630, M8900, H8779 and PVA films of corresponding solubility and deformability characteristics.

Further preferred films are those described in US2006/0213801, WO 2010/119022, US2011/0188784, and U.S. Pat. No. 6,787,512.

The film material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

The film is soluble or dispersible in water, and preferably has a water-solubility of at least 50%, preferably at least 75% or even at least 95%, as measured by the method set out here after using a glass-filter with a maximum pore size of 20 microns: 50 grams±0.1 gram of film material is added in a pre-weighed 400 ml beaker and 245 ml*1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

The film may comprise an area of print. The area of print may cover the entire film or part thereof. The area of print may comprise a single colour or maybe comprise multiple colours, even three colours. The area of print may comprise white, black and red colours. The area of print may comprise pigments, dyes, blueing agents or mixtures thereof. The print may be present as a layer on the surface of the film or may at least partially penetrate into the film.

Other Adjunct Ingredients

A wide variety of other ingredients may be used in the detergent compositions herein, including other active ingredients, carriers, hydrotropes, processing aids, dyes or pigments, solvents for liquid formulations, and solid or other liquid fillers, erythrosine, colliodal silica, waxes, probiotics, surfactin, aminocellulosic polymers, Zinc Ricinoleate, perfume microcapsules, rhamnolipids, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, silicate salts (e.g., sodium silicate, potassium silicate), choline oxidase, pectate lyase, mica, titanium dioxide coated mica, bismuth oxychloride, and other actives.

The detergent compositions described herein may also contain vitamins and amino acids such as: water soluble vitamins and their derivatives, water soluble amino acids and their salts and/or derivatives, water insoluble amino acids viscosity modifiers, dyes, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The detergent compositions of the present invention may also contain pigment materials such as nitroso, monoazo, disazo, carotenoid, triphenyl methane, triaryl methane, xanthene, quinoline, oxazine, azine, anthraquinone, indigoid, thionindigoid, quinacridone, phthalocianine, botanical, and natural colors, including water soluble components such as those having C.I. Names. The detergent compositions of the present invention may also contain antimicrobial agents.

Processes of Making Detergent Compositions

The detergent compositions of the present invention can be formulated into any suitable form and prepared by any process chosen by the formulator.

Methods of Use

The present invention includes methods for cleaning soiled material. As will be appreciated by one skilled in the art, the cleaning compositions of the present invention are suited for use in laundry pretreatment applications, laundry cleaning applications, and home care applications.

Such methods include, but are not limited to, the steps of contacting cleaning compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the cleaning compositions described herein with soiled fabric. Following pretreatment, the soiled fabric may be laundered in a washing machine or otherwise rinsed.

Machine laundry methods may comprise treating soiled laundry with an aqueous wash solution in a washing machine having dissolved or dispensed therein an effective amount of a machine laundry cleaning composition in accord with the invention. An "effective amount" of the cleaning composition means from about 20 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 30:1. The compositions may be employed at concentrations of from about 500 ppm to about 15,000 ppm in solution. In the context of a fabric laundry composition, usage levels may also vary depending not only on the type and severity of the soils and stains, but also on the wash water temperature, the volume of wash water, and the type of washing machine (e.g., top-loading, front-loading, top-loading, vertical-axis Japanese-type automatic washing machine).

The cleaning compositions herein may be used for laundering of fabrics at reduced wash temperatures. These methods of laundering fabric comprise the steps of delivering a laundry cleaning composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry cleaning composition with water.

Another method includes contacting a nonwoven substrate impregnated with an embodiment of the cleaning composition with soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the tradenames SONTARA® by DuPont and POLYWEB® by James River Corp.

Hand washing/soak methods, and combined handwashing with semi-automatic washing machines, are also included.

Machine Dishwashing Methods

Methods for machine-dishwashing or hand dishwashing soiled dishes, tableware, silverware, or other kitchenware, are included. One method for machine dishwashing comprises treating soiled dishes, tableware, silverware, or other kitchenware with an aqueous liquid having dissolved or dispensed therein an effective amount of a machine dishwashing composition in accord with the invention. By an effective amount of the machine dishwashing composition it is meant from about 8 g to about 60 g of product dissolved or dispersed in a wash solution of volume from about 3 L to about 10 L.

One method for hand dishwashing comprises dissolution of the cleaning composition into a receptacle containing water, followed by contacting soiled dishes, tableware, silverware, or other kitchenware with the dishwashing liquor, then hand scrubbing, wiping, or rinsing the soiled dishes, tableware, silverware, or other kitchenware. Another method for hand dishwashing comprises direct application of the cleaning composition onto soiled dishes, tableware, silverware, or other kitchenware, then hand scrubbing, wiping, or rinsing the soiled dishes, tableware, silverware, or other kitchenware. In some examples, an effective amount of cleaning composition for hand dishwashing is from about 0.5 ml. to about 20 ml. diluted in water.

Packaging for the Compositions

The cleaning compositions described herein can be packaged in any suitable container including those constructed from paper, cardboard, plastic materials, and any suitable laminates. An optional packaging type is described in European Application No. 94921505.7.

Multi-Compartment Pouch Additive

The cleaning compositions described herein may also be packaged as a multi-compartment cleaning composition.

EXAMPLES

In the following examples, the individual ingredients within the cleaning compositions are expressed as percentages by weight of the cleaning compositions.

Example 1

Technical stain swatches of blue knitted cotton containing Beef Fat, Pork Fat and Bacon Grease were purchased from Warwick Equest Ltd. and washed in conventional western European washing machines (Miele Waschmaschine Softronic W 2241), selecting a 59 min washing cycle without heating (wash at 17° C.) and using 75 g of liquid detergent composition LA1 (Table 10) (nil-polyetheramine) or 75 g of LA1 mixed with 1.25 g of a polyetheramine, which is neutralized with hydrochloric acid before it is added to LA1. The pH of 75 g of LA1 (Table 10) in 1 L water is pH=8.3. Water hardness was 2.5 mM ($Ca^{2+}$: $Mg^{2+}$ was 3:1).

Standard colorimetric measurement was used to obtain L*, a* and b* values for each stain before and after the washing. From L*, a* and b* values, the stain level was calculated.

Stain removal from the swatches was measured as follows:

$$\text{Stain Removal Index } (SRI) = \frac{\Delta E_{initial} - \Delta E_{washed}}{\Delta E_{initial}} \times 100$$

$\Delta E_{initial}$=Stain level before washing $\Delta E_{washed}$=Stain level after washing Six replicates of each stain type were prepared. The SRI values shown below are the averaged SRI values for each stain type. The stain level of the fabric before the washing ($\Delta E_{initial}$) is high; in the washing process, stains are removed and the stain level after washing is reduced ($\Delta E_{washed}$). The better a stain has been removed, the lesser the value for $\Delta E_{washed}$ and the greater the difference between $\Delta E_{initial}$ and $\Delta E_{washed}$ ($\Delta E_{initial}-\Delta E_{washed}$). Therefore the value of the stain removal index increases with better washing performance.

TABLE 10

Liquid Detergent Composition LA1

| Ingredients of liquid detergent composition LA1 | percentage by weight |
|---|---|
| Alkyl Benzene sulfonate[1] | 7.50% |
| AE3S[2] | 2.60% |
| AE9[3] | 0.40% |
| NI 45-7[4] | 4.40% |
| Citric Acid | 3.20% |
| C1218 Fatty acid | 3.10% |
| Amphiphilic polymer[5] | 0.50% |
| Zwitterionic dispersant[6] | 1.00% |
| Ethoxylated Polyethyleneimine[7] | 1.51% |
| Protease[8] | 0.89% |
| Natalase[9] | 0.21% |
| Chelant[10] | 0.28% |
| Brightener[11] | 0.09% |
| Solvent | 7.35% |
| Sodium Hydroxide | 3.70% |
| Fragrance & Dyes | 1.54% |
| Water, filler, stucturant | To Balance |

[1]Linear alkylbenenesulfonate having an average aliphatic carbon chain length C11-C12 supplied by Stepan, Northfield Illinois, USA

[2]AE3S is C12-15 alkyl ethoxy (3) sulfate supplied by Stepan, Northfield, Illinois, USA

[3]AE9 is C12-14 alcohol ethoxylate, with an average degree of ethoxylation of 9, supplied by Huntsman, Salt Lake City, Utah, USA

[4]NI 45-7 is C14-15 alcohol ethoxylate, with an average degree of ethoxylation of 7, supplied by Huntsman, Salt Lake City, Utah, USA

[5]Amphilic polymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

[6]A compound having the following general structure: bis((C2H5O)(C2H4O)*n*)(CH3)—N+—CxH2*x*—N+—(CH3)-bis((C2H5O)(C2H4O)*n*), wherein n = from 20 to 30, and x = from 3 to 8, or sulphated or sulphonated variants thereof

[7]Polyethyleneimine (MW = 600) with 20 ethoxylate groups per —NH

[8]Protease may be supplied by Genencor International, Palo Alto, California, USA

[9]Natalase ® is a product of Novozymes, Bagsvaerd, Denmark.

[10]A suitable chelant is diethylene triamine penta(methyl phosphonic) acid supplied by Solutia, St Louis, Missouri, USA;

[11]Fluorescent Brightener 1 is Tinopal ® AMS, Fluorescent Brightener 2 supplied by Ciba Specialty Chemicals, Basel, Switzerland

TABLE 11

Wash results (given in SRI units)

| Stain | A (nil additional polyetheramine) | B (comparative polyetheramine) | C |
|---|---|---|---|
| Beef Fat | 70.2 | 72.1 | 78.3 |
| Pork Fat | 70.1 | 70.9 | 76.3 |
| Bacon Grease | 69.2 | 71.4 | 80.0 |

A: liquid detergent composition LA1 (see Table 10) nil-polyetheramine.

B: liquid detergent composition LA1 (see Table 10) containing a polyetheramine sold under the trade name Polyetheramine ® D 230 or JEFFAMINE ® D-230 or Baxxodur ® EC301 (e.g., (2-Aminomethylethyl)-omega-(2-aminomethylethoxy)-poly(oxy(methyl-1, 2-ethandiyl)).

C: liquid detergent composition LA1 (see Table 10) containing a polyetheramine prepared according to Example 4.

The cleaning composition containing a polyetheramine according to the present disclosure (see Table 11: C) shows superior grease cleaning effects over the nil-polyetheramine detergent composition (see Table 11: A) and also show superior grease cleaning effects over the cleaning composition containing the polyetheramine of the comparative example (see Table 11: B).

Example 2

Liquid Detergent A (see Table 12) is a conventional laundry detergent containing a polyetheramine sold under the trade name Polyetheramine® D 230; Liquid Detergent B (see Table 12) comprises the polyetheramine of Example 4.

Technical stain swatches of cotton CW120 containing burnt butter, hamburger grease, margarine, taco grease were purchased from Empirical Manufacturing Co., Inc (Cincinnati, Ohio). The swatches were washed in a Miele front loader washing machine, using 14 grains per gallon water hardness and washed at 15° C. The total amount of liquid detergent used in the test was 80 grams.

Standard colorimetric measurement was used to obtain L*, a* and b* values for each stain before and after the washing. From L*, a* and b* values the stain level was calculated. The stain removal index was then calculated according to the SRI formula shown above. Eight replicates of each stain type were prepared. The SRI values shown below (Table 13) are the averaged SRI values for each stain type.

TABLE 12 composition of the liquid detergents

| | Liquid Detergent A (%) | Liquid Detergent B (%) |
|---|---|---|
| AES $C_{12-15}$ alkyl ethoxy (1.8) sulfate | 14.0 | 14.0 |
| Alkyl benzene sulfonic acid | 2.0 | 2.0 |
| Nonionic 24-9[4] | 1.0 | 1.0 |
| C12/14 Amine Oxide | 0.2 | 0.2 |
| Polyetheramine[2] | — | 1.0 |
| Polyetheramine[3] | 1.0 | — |
| Citric Acid | 3.4 | 3.4 |
| Borax | 2.8 | 2.8 |
| Zwitterionic dispersant[5] | 1.1 | 1.1 |
| Ethoxylated Polyethyleneimine[1] | 1.5 | 1.5 |
| Sodium hydroxide | 3.7 | 3.7 |
| DTPA[6] | 0.3 | 0.3 |
| Protease | 0.8 | 0.8 |
| Amylase: Natalase ® | 0.14 | 0.14 |
| 1,2-Propanediol | 3.9 | 3.9 |
| Monoethanolamine (MEA) | 0.3 | 0.3 |
| Sodium Cumene Sulfonate | 0.9 | 0.9 |
| Water & other components | Balance | Balance |
| pH | 8.3 | 8.3 |

[1]Polyethyleneimine (MW = 600) with 20 ethoxylate groups per —NH

[2]The polyetheramine composition as described in Synthesis Example 4.

[3]Polyetheramine (2-Aminomethylethyl)-omega-(2-aminomethylethoxy)-poly(oxy (methyl-1,2-ethandiyl)), sold under the trade name Polyetheramine D 230.

[4]Nonionic 24-9 is a C12-14 alcohol ethoxylate, with an average degree of ethoxylation of 9

[5]A compound having the following general structure: bis((C2H5O)(C2H4O)*n*)(CH3)—N—+—CxH2*x*—N+—(CH3)-bis((C2H5O)(C2H4O)*n*), wherein n = from 20 to 30, and x = from 3 to 8, or sulphated or sulphonated variants thereof

[6]DTPA is diethylenetetraamine pentaacetic acid

TABLE 13

Cleaning Results

| Soils | Liquid Detergent A | Liquid Detergent B (results given as delta SRI vs. Liquid Detergent A) |
|---|---|---|
| Margarine | 88.2 | 1.7 |
| Grease burnt butter | 76.7 | 5.1 |
| Grease hamburger | 68.0 | 8.2 |
| Grease taco | 55.2 | 7.4 |

These results illustrate the surprising grease removal benefit of the polyetheramine of Example 4 as compared to Polyetheramine® D 230, especially on difficult-to-remove, high-frequency consumer stains like hamburger grease and taco grease.

Example 3

The following composition is encapsulated in a water-soluble pouch to make a unit dose article.

TABLE 14

| Raw Material | wt % |
|---|---|
| Anionic Surfactant HF | 18.2 |
| LAS[1] | |
| C14-15 alkyl ethoxy (2.5) sulfate | 8.73 |
| C14-15 alkyl ethoxy (3.0) sulfate | 0.87 |
| AE9[2] | 15.5 |
| TC Fatty acid[15] | 6.0 |
| Citric Acid | 0.6 |
| FN3 protease[3] | 0.027 |
| FNA protease[4] | 0.071 |
| Natalase[5] | 0.009 |
| Termamyl Ultra[6] | 0.002 |
| Mannanase[7] | 0.004 |
| PEI ethoxylate dispersant[9] | 5.9 |
| RV-base[10] | 1.5 |
| DTPA[11] | 0.6 |
| EDDS[12] | 0.5 |
| Fluorescent Whitening Agent 49 | 0.1 |
| 1,2 propylene diol | 15.3 |
| Glycerol | 4.9 |
| Monoethanolamine | 6.6 |
| NaOH | 0.1 |
| Sodium Bisulfite | 0.3 |
| Calcium Formate | 0.08 |
| Polyethylene Glycol (PEG) 4000 | 0.1 |
| Fragrance | 1.6 |
| Dyes | 0.01 |
| Polyetheramine[14] | 1.0 |
| Water | TO BALANCE 100% |

[1]Linear Alkyl Benzene Sasol, Lake Charles, LA

[2]AE9 is C12-14 alcohol ethoxylate, with an average degree of ethoxylation of 9, supplied by Huntsman, Salt Lake City, Utah, USA

[3]Protease supplied by Genencor International, Palo Alto, California, USA (e.g. Purafect Prime ®)

[4]Protease supplied by Genencor International, Palo Alto, California, USA

[5]Natalase ®supplied by Novozymes, Bagsvaerd, Denmark

[6]Termamyl Ultra supplied by Novozymes, Bagsvaerd, Denmark

[7]Mannanase ®supplied by Novozymes, Bagsvaerd, Denmark

[8]Whitezyme supplied by Novozymes, Bagsvaerd, Denmark

[9]Polyethyleneimine (MW = 600) with 20 ethoxylate groups per —NH

[10]Sokalan 101 Polyethyleneglycol-Polyvinylacetate copolymer dispersant supplied by BASF

[11]Suitable chelants are, for example, diethylenetetraamine pentaacetic acid (DTPA) supplied by Dow Chemical, Midland, Michigan, USA

[12]Ethylenediaminedisuccinic acid supplied by Innospec Englewood, Colorado, USA

[13]Suitable Fluorescent Whitening Agents are for example, Tinopal ® AMS, Tinopal ® CBS-X, Sulphonated zinc phthalocyanine Ciba Specialty Chemicals, Basel, Switzerland

[14]Polyetheramine composition made according to Synthesis Example 4.

[15]Topped Coconut Fatty Acid Twin Rivers Technologies Quincy Massachusetts

Example 4

Technical stain swatches of blue knitted cotton containing Beef Fat, Pork Fat and Bacon Grease were purchased from Warwick Equest Ltd. and washed in conventional western European washing machines (Miele Waschmaschine Softronic W 2241), selecting a 59 min washing cycle without heating (wash at 17° C.) and using 75 g of liquid detergent composition LA1 (Table 15) (nil-polyetheramine) or 75 g of LA1 mixed with 1.25 g of a polyetheramine, which is neutralized with hydrochloric acid before it is added to LA1.

The pH of 75 g of LA1 (Table 15) in 1 L water is pH=8.3. Water hardness was 2.5 mM ($Ca^{2+}$:$Mg^{2+}$ was 3:1).

Standard colorimetric measurement was used to obtain L*, a* and b* values for each stain before and after the washing. From L*, a* and b* values, the stain level was calculated. The stain removal index was then calculated according to the SRI formula shown above (see Example 1).

TABLE 15 liquid detergent composition LA1

| Ingredients of liquid detergent composition LA1 | percentage by weight |
|---|---|
| Alkyl Benzene sulfonate[1] | 7.50% |
| AE3S[2] | 2.60% |
| AE9[3] | 0.40% |
| NI 45-7[4] | 4.40% |
| Citric Acid | 3.20% |
| C12-18 Fatty acid | 3.10% |
| Amphiphilic polymer[5] | 0.50% |
| Zwitterionic dispersant[6] | 1.00% |
| Ethoxylated Polyethyleneimine[7] | 1.51% |
| Protease[8] | 0.89% |
| Enymes[9] | 0.21% |
| Chelant[10] | 0.28% |
| Brightener[11] | 0.09% |
| Solvent | 7.35% |
| Sodium Hydroxide | 3.70% |
| Fragrance & Dyes | 1.54% |
| Water, filler, stucturant | To Balance |

[1]Linear alkylbenenesulfonate having an average aliphatic carbon chain length C11-C12 supplied by Stepan, Northfield Illinois, USA
[2]AE3S is C12-15 alkyl ethoxy (3) sulfate supplied by Stepan, Northfield, Illinois, USA
[3]AE9 is C12-14 alcohol ethoxylate, with an average degree of ethoxylation of 9, supplied by Huntsman, Salt Lake City, Utah, USA
[4]NI 45-7 is C14-15 alcohol ethoxylate, with an average degree of ethoxylation of 7, supplied by Huntsman, Salt Lake City, Utah, USA
[5]Amphilic polymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[6]A compound having the following general structure: bis((C2H5O)(C2H4O)*n*)(CH3)—N+—CxH2x—N+—(CH3)-bis((C2H5O)(C2H4O)*n*), wherein n = from 20 to 30, and x = from 3 to 8, or sulphated or sulphonated variants thereof
[7]Polyethyleneimine (MW = 600) with 20 ethoxylate groups per —NH
[8]Proteases may be supplied by Genencor International, Palo Alto, California, USA (e.g. Purafect Prime ®)
[9]Natalase ®, is a product of Novozymes, Bagsvaerd, Denmark.
[10]A suitable chelant is diethylene triamine penta(methyl phosphonic) acid supplied by Solutia, St Louis, Missouri, USA;
[11]Fluorescent Brightener 1 is Tinopal ® AMS, Fluorescent Brightener 2 supplied by Ciba Specialty Chemicals, Basel, Switzerland

TABLE 16

Wash Results:

| Stain | A | B | C | D | E |
|---|---|---|---|---|---|
| Beef Eat | 61.1 | 63.4 | 67.8 | 69.5 | 69.9 |
| Pork Pat | 58.5 | 61.2 | 67.6 | 71.3 | 71.2 |
| Bacon Grease | 62.4 | 64.9 | 71.2 | 73.3 | 73.7 |

A: liquid detergent composition LA1 (see Table 15) nil-polyetheramine.
B: liquid detergent composition LA1 (see Table 15) containing a polyetheramine sold under the trade name Polyetheramine ® D 230 or JEFFAMINE ® D-230 or Baxxodur ® EC301 (e.g., (2-Aminomethylethyl)-omega-(2-aminomethylethoxy)-poly(oxy(methyl-1, 2-ethandiyl).
C: liquid detergent composition LA1 (see Table 15) containing 1.25 g of a polyetheramine of Example 5.
D: liquid detergent composition LA1 (see Table 15) containing 1.25 g of a polyetheramine of Example 6.
E: liquid detergent composition LA1 (see Table 15) with 1.25 g of a polyetheramine described of Example 7.

What is claimed is:

1. A cleaning composition comprising:

from about 1% to about 70%, by weight of the composition, of a surfactant; and from about 0.1% to about 10% of a polyetheramine of Formula (I):

Formula (I)

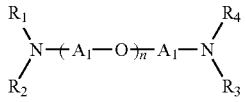

wherein each $A_1$ group is independently selected from the group consisting of a saturated or unsaturated, straight or branched alkylene radical and a cycloalkylene radical, each of $R_1$-$R_4$ is independently selected from the group consisting of H, a straight or branched alkyl, and a cycloalkyl, n is from about 1 to about 200, at least one of the $A_1$ groups is Formula (VI)

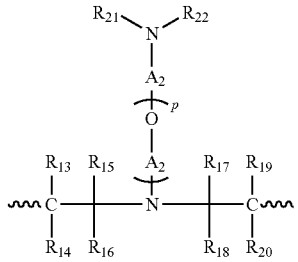

wherein each $A_2$ group is independently selected from the group consisting of a saturated or unsaturated, straight or branched alkylene radical and a cycloalkylene radical, each of $R_{13}$-$R_{22}$ is independently selected from H, a linear or branched $C_1$-$C_{12}$ alkyl, or a cycloalkyl, and p is from about 0 to about 13; and at least one of the $A_1$ groups is:

Formula (II)

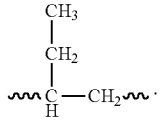

2. The cleaning composition of claim 1 wherein said polyetheramine of Formula (I) further comprises at least one $A_1$ group selected from:

Formula (VII)

wherein q is 0 or 1; or

Formula (VIII)

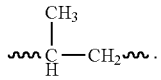

3. The cleaning composition of claim 1 wherein said polyetheramine of Formula (I) further selected from: comprises at least one $A_1$ group selected from:

Formula (III)

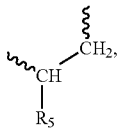

wherein $R_5$ is selected from a linear or branched $C_1$-$C_{12}$ alkyl or a cycloalkyl;

Formula (IV)

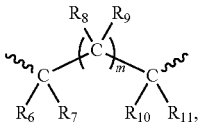

wherein each of $R_6$-$R_{11}$ is independently selected from H, a linear or branched $C_1$-$C_{12}$ alkyl, or a cycloalkyl and m is from about 2 to about 13;

Formula (V)

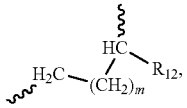

wherein $R_{12}$ is a linear or branched $C_1$-$C_{12}$ alkyl, or a cycloalkyl and m is from about 2 to about 13;

Formula (VII)

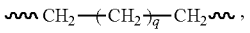

wherein q is 0 or 1; or

Formula (VIII)

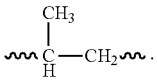

4. The cleaning composition of claim 1 wherein said polyetheramine of Formula (I) further comprises at least one $A_1$ group selected from:

Formula (IX)

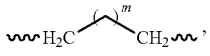

wherein m is from about 2 to about 13.

5. The cleaning composition of claim 1 wherein in said polyetheramine of Formula (I), each of $R_1$-$R_4$ is H.

6. The cleaning composition of claim 1 wherein in said polyetheramine of Formula (I), each of $R_1$-$R_4$ is independently selected from the group consisting of H, butyl, ethyl, methyl, propyl, and phenyl.

7. The cleaning composition of claim 1 wherein in said polyetheramine of Formula (I), n is from about 2 to about 10.

8. The cleaning composition of claim 1 wherein in said polyetheramine of Formula (I), n is from about 3 to about 5.

9. The cleaning composition of claim 1 wherein in said polyetheramine of Formula (I) at least one of the $A_1$ groups is selected from:

Formula (III)

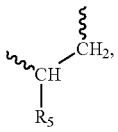

wherein $R_5$ is selected from a linear or branched $C_1$-$C_{12}$ alkyl or a cycloalkyl;

Formula (IV)

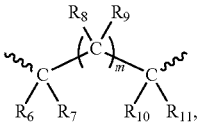

wherein each of $R_6$-$R_{11}$ is independently selected from H, a linear or branched $C_1$-$C_{12}$ alkyl, or a cycloalkyl and m is from about 2 to about 13;

Formula (V)

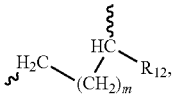

wherein $R_{12}$ is selected from H, a linear or branched $C_1$-$C_{12}$ alkyl, or a cycloalkyl and m is from about 2 to about 13.

10. The cleaning composition of claim 1, wherein said polyetheramine has a weight average molecular weight of about 290 to about 900 grams/mole.

11. The cleaning composition of claim 1 further comprising from about 0.0001% to about 1% by weight of enzyme.

12. The cleaning composition of claim 1 further comprising from about 0.1% to about 10% by weight of an additional amine, wherein said additional amine is selected from oligoamines, triamines, diamines, or a combination thereof.

13. A method of pretreating or treating a soiled fabric comprising contacting the soiled fabric with the cleaning composition of claim 1.

* * * * *